US011298906B2

(12) United States Patent
Mayer

(10) Patent No.: US 11,298,906 B2
(45) Date of Patent: Apr. 12, 2022

(54) GROOVE PLATE PLATFORM FOR VERTICAL PRESS MACHINES

(71) Applicant: Ryan Mayer, Phoenix, AZ (US)

(72) Inventor: Ryan Mayer, Phoenix, AZ (US)

( * ) Notice: Subject to any disclaimer, the term of this patent is extended or adjusted under 35 U.S.C. 154(b) by 186 days.

(21) Appl. No.: 16/422,900

(22) Filed: May 24, 2019

(65) Prior Publication Data

US 2020/0147917 A1 May 14, 2020

Related U.S. Application Data

(63) Continuation-in-part of application No. 16/190,124, filed on Nov. 13, 2018, now abandoned.

(51) Int. Cl.

| | |
|---|---|
| ***B30B 15/34*** | (2006.01) |
| ***B30B 15/06*** | (2006.01) |
| ***B30B 9/04*** | (2006.01) |
| ***B30B 15/32*** | (2006.01) |
| ***B30B 1/18*** | (2006.01) |

(52) U.S. Cl.

CPC ..... *B30B 15/32* (2013.01); *B30B 1/181* (2013.01); *B30B 9/04* (2013.01); *B30B 15/064* (2013.01); *B30B 15/34* (2013.01)

(58) Field of Classification Search

CPC ..... B30B 9/04; B30B 9/045; B30B 9/047; B30B 9/10; B30B 15/062; B30B 15/064; B30B 15/34

USPC ..... 100/315, 326

See application file for complete search history.

(56) References Cited

U.S. PATENT DOCUMENTS 1,469,747 A * 10/1923 Winter ..... B30B 15/064 425/470

9,844,229 B2 * 12/2017 Wettlaufer ..... B30B 9/06

* cited by examiner

*Primary Examiner* — Jimmy T Nguyen

(74) *Attorney, Agent, or Firm* — Cynthia S. Lamon; Lamon Patent Services

(57) ABSTRACT

A press plate block is provided and has capacity to conduct and transfer heat, a mounting interface for mounting the block onto a press machine, a press surface defining a press footprint the press surface elevated above the rest of the top surface area and having a peripheral edge, a first and second interface for accepting heating and temperature sensing components, a first radiused groove disposed adjacently to the peripheral edge of the press surface and a second radiused groove disposed orthogonally to the first groove, the second groove intersecting the first groove at a lower elevation, the second groove breaking out of the block at one end of the block.

17 Claims, 14 Drawing Sheets section AA section BB

GROOVE PLATE PLATFORM FOR VERTICAL PRESS MACHINES

CROSS-REFERENCED APPLICATIONS

This application is a continuation-in-part of U.S. patent application Ser. No. 16/190,124, filed on Nov. 13, 2018, which is hereby incorporated by reference herein in its entirety including the drawings.

BACKGROUND OF THE INVENTION

Field of the Invention

The present invention is in the field of extracting essential compounds from organic plant materials and pertains particularly to methods and apparatus for pressing organic materials under heated conditions to extract essential compounds.

Discussion of the State of the Art

In the field of organic material processing, there are commercial systems available for closed loop solvent processing of organic materials such as *cannabis* and hemp, for example. In the case of *cannabis*, desired compounds within the organic *cannabis* materiel such as trichomes for example can be separated from the raw material using solvent gasses and cooling means. Drawbacks to this approach include events where residual carbons or other chemical residues from solvents may contaminate the final product, and events where safety may be compromised by solvent leaks or spills.

More recently in the art, commercial press systems have become available that do not require solvents where material may be compressed under heat conditions to squeeze melted compounds in the form of more viscous liquids from organic raw materials. These commercial presses typically use air compressors and or hydraulic pressure systems to operate linear press components creating noise, safety issues, and maintenance issues including seal replacement, fluid replacement, valve replacement, and like issues. Such systems may not be easily scaled down for non-commercial use because of cost and required adherence to numerous safety issues and regulations.

The interfacing components of any press system comprise a press plate platform wherein at least one plate or press surface is fixed while another is mobile. One drawback with current plate platforms is that the final product is typically collected off the plate surface or from a paper fold by dabbing the product or otherwise scraping the product off the medium.

The inventor is aware of a press that includes a press platform with an upper and lower press plate wherein the lower press plate includes a groove for transporting final product in a more viscous form off the plate and into a collection tray at least for a desktop sized press machine. The plates are heated to a specific temperature for press and subjected to a press time observed relative to the amount pressed and pressure used to squeeze extract into the groove. It is important that the materials be directed out of the lower plate as some degradation to the quality or purity of the final product might occur if exposed to heated conditions for too long a period.

Therefore, what is clearly needed is a modular and scalable press groove plate platform and supporting thermal and electric interfaces for incorporation into a linear press system for extracting oils or resins from pressed organic materials.

BRIEF SUMMARY OF THE INVENTION

This application provides a mechanical press, which may include a platform base plate having a length, a width, and a uniform thickness, a device housing secured centrally over the platform base plate, the device housing having at least front, rear, two side panels, and a top panel having uniform thickness, an electric linear actuator assembly disposed centrally and in a vertical orientation within the device housing and fixedly mounted to the platform base plate in strategic position within the device housing, the linear actuator including a travel screw having a lower fixed gear, an actuator connection block hosting a planetary gear set, and an electric motor having a drive gear fixed to the motor shaft, a lift collar having a lower annular tube section with internal threading matching the external threading on the travel screw and an upper attachment seat fixed to a lower press plate platform having a length a width, and a uniform thickness, two or more vertical track posts having a uniform length and diameter arranged and spaced apart symmetrically, the track posts fixedly mounted to the device housing and extending vertically through the lower press plate platform through provided openings placed through the platform, the track posts functioning as a lift track for the lower press plate platform, a lower press plate having a length, a width, and a maximum thickness centrally mounted to the top surface of the lower press plate platform, an upper press plate platform having a length, a width, and a maximum thickness, the upper press plate platform aligned with and held in a same planar relationship to the lower press plate platform, the upper press plate platform having openings placed orthogonally therethrough to accept the track posts and wherein the upper press plate platform is fixed to the track posts at the upper ends of the posts, an upper press plate having a length, a width, and a uniform maximum thickness centrally mounted to the bottom surface of the upper press plate platform sharing vertical alignment and a parallel planar relationship with the lower press plate, a first electric heating element embedded into the lower press plate, a second electric heating element embedded into the upper press plate, the first and second electric heating elements including at least one feedback sensor to report temperature, a heating control interface and display including at least one electronic circuit for driving the heating control interface and display, a press activation interface including an electric button for raising the lower press plate platform to press and an electric button for releasing the lower press plate platform from press, and a power supply mounted within the device housing and connected by wire to the electric motor, the first and second heating elements, and to the at least one electronic circuit driving the heating control interface and display.

In any embodiment described herein, the press force may be combined with active heating of the lower and upper press plates acts on raw material placed between the press plates to extract resins, oils, extracts, or compounds from the ram material, the heat rendering the resins, oils, extracts, or compounds in a highly viscous liquid state. In one embodiment, the lower press plate may have a convex press surface, the upper press plate having a matching concave press surface. In another embodiment, the lower press plate has a conical press surface, the upper press plate having a matching funnel surface.

In any embodiment described herein, the press force created by the linear actuator may be equal to or greater than 1,500 pounds per square inch. In any embodiment described herein, the mechanical press may further include a groove milled along a groove pattern around the press plate surface of the lower press plate, the groove including an exit chute breaking out of the press plate, the groove bottom graduating downward from the rear of the plate to the front of the plate and out of the exit chute. In any embodiment described herein, the material pressed may be protected in a fold of parchment paper and the pressed resins, oils, extracts, or compounds are collected off the parchment paper. In any embodiment described herein, the maximum press force is adjustable. In any embodiment described herein, the distance that the lower press plate platform recedes after press release may be set by a user. In another embodiment, parchment paper may be replaced by another material, such as foil or any other heat-resistant material with a non-stick surface known in the art.

This application also provides a unique press plate that can be scaled to interface with any press system known or contemplated in the art. Said press systems may be suitable for commercial use and/or private use to process organic materials, including but not limited to *cannabis* and hemp. The press plate described herein having a capacity to conduct and transfer heat, and having an overall length, an overall width, and an overall thickness, a mounting interface disposed on the underside of the press plate for mounting the press plate onto a press machine, a press surface defining a press footprint disposed on top of the press plate, the press surface elevated from the remainder of the top surface area of the press plate, the press surface having a peripheral edge, a first interface provided within the press plate for accepting one or more heating components, a second interface provided within the press plate for accepting one or more temperature sensing and/or feedback components, a first groove disposed adjacently to the peripheral edge of the press surface such that the edge of the press plate surface and groove are the same edge, and a second groove disposed orthogonally to the first groove, the second groove intersecting the first groove at a lower elevation, the second groove breaking out of the press plate at one end of the press plate.

In any embodiment herein, the press plate block may be fabricated of steel, aluminum, titanium, one or more metal alloy, and/or any combination thereof. In any embodiment described herein, the mounting interface may be a pattern of threaded openings for mounting the plate to a platform base of a press machine. In any embodiment described herein, the press surface may have a diameter and the first groove may be a circular groove bounding the press surface. In any embodiment described herein, the first and second interfaces for accepting one or more heating elements and/or temperature sensors may be machined into the press plate as one or more compartments or bores for accepting the implements within the press plate.

In any embodiment described herein, the one or more heating elements may be a ceramic heating element and the one or more temperature and feedback sensors is a thermocouple.

In a preferred embodiment, the first groove is graduated in depth from a shallow depth at the rear of the press plate to a deeper depth at the intersection with the second groove at the front of the block and the second groove is graduated is depth from a shallow depth at the intersection with the first groove to a deeper depth at the edge of the press plate. In this embodiment the first and second grooves are radiused grooves. Also, in this embodiment, the press plate may be a lower plate mountable to a vertical press machine leveraging heat, pressure, and gravity to transfer pressed liquid from the press surface off the plate through the first and second grooves.

In any embodiment described herein, the press plate may be provided with other components including a second opposing press plate having a press plate surface and foot print matching the grooved press plate as a press plate platform for installation into a vertical press machine. In a variation of this embodiment, the second press plate may have a first interface provided within the press plate for accepting one or more heating components and a second interface within the press plate for accepting one or more temperature sensing and feedback components. In this variation, the other components may include the heating elements, thermocouples, power lines, control lines, and feedback lines, and at least one controller for heating the plates.

In one variation of an embodiment described herein, the plates may be built to size for a specified capacity of vertical press machine the capacity ranging from a machine pressing one ounce of material in a portable desktop vertical press machine to a machine pressing up to one and one half pounds of organic material in a commercial vertical press machine.

In another aspect, Applicant provides a method for extracting oils and/or extracts from organic materials using a press plate having a capacity through one or more heating elements to conduct and transfer heat and one or more temperature sensors to provide user feedback for heat adjustments, a mounting interface for mounting the press plate onto a press machine, a press surface defining a press footprint the press surface elevated having a peripheral edge, a first groove disposed adjacently to the peripheral edge of the press surface and a second groove disposed orthogonally to the first groove, the second groove intersecting the first groove and breaking out of the press plate.

The method may include steps for (a) heating the press plate to a temperature sufficient to liquify and separate organic compounds in the organic materials, (b) placing an amount of organic materials on the press surface of the plate, (c) pressing the organic materials with the aid of an opposing press plate having a like press surface and a capacity through one or more heating elements to conduct and transfer heat and one or more temperature sensors to provide feedback, and (d) collecting liquid oils and or extracts having flowed down the first and second grooves into a collection vessel.

In one aspect of the method, the press plate may be provided with other components including a second opposing press plate having a press plate surface and foot print matching the grooved press plate as a press plate platform for installation into a vertical press machine. In this aspect, other components may include the heating elements, thermocouples, power lines, control lines, and feedback lines, and at least one controller for heating the plates.

In another aspect of the method in step (a), the temperature and the press times are preset for the amount of organic material pressed. In yet another aspect of the method, in step (b), the raw material for press is placed in a filter adapted to prevent particulate matter from entering the first groove. In a preferred aspect, the first and second grooves are radiused grooves.

DETAILED DESCRIPTION OF THE INVENTION

The inventors provide a unique organic press and methods of use thereof that enables completely organic processing of a raw plant material to a viscous (low viscosity) extract product. The present invention is described in enabling detail using the following examples, which may describe more than one relevant embodiment falling within the scope of the present invention.

One goal of the invention is to enable resins, oils, extracts, or compounds of raw plant materials to be chemically and physically separated from the plant material by means of pressing the material between two press plates, the press plates having a means to heat to a desired temperature for heating the pressed material. Another goal of the invention is to provide a linear press means that may produce a press force capacity of approximately 1,500 pounds per square inch between the press plates, wherein the linear press means avoids compressor components or hydraulic components that may be cumbersome, noisy and may be the source of contamination and may be difficult to scale down for consumer market use.

Another goal of the present invention is to have a press drive means such as a linear actuation device that runs on electricity to achieve relatively silent, efficient and repeated pressing of multiple sequential press loads consisting of raw material, wherein the resins, extracts, oils, or compounds may be pressed onto a parchment paper, or into a groove for transfer of the highly viscous resin, oil, extract, or compound to a means for collection like a receptacle like a tray.

It may be an object of the invention to secure a means for lifting the lower press plate utilizing the linear actuator by having a vertical travel screw that may be turned in place support a lift collar threaded over the travel screw, the lift collar fixed to a vertically tracked platform that hosts the lower of the two press plates, wherein the track system comprises at least two vertical track posts.

One object of the invention may be to provide a means, in addition to heat and press force, to further assist separation of the viscous resins, oils, extracts, or compounds from the raw plant materials by shaping the press surfaces of the two press plates and or by sloping the groove bottom at an angle from horizontal toward the destination point for product collection.

Figure 1:
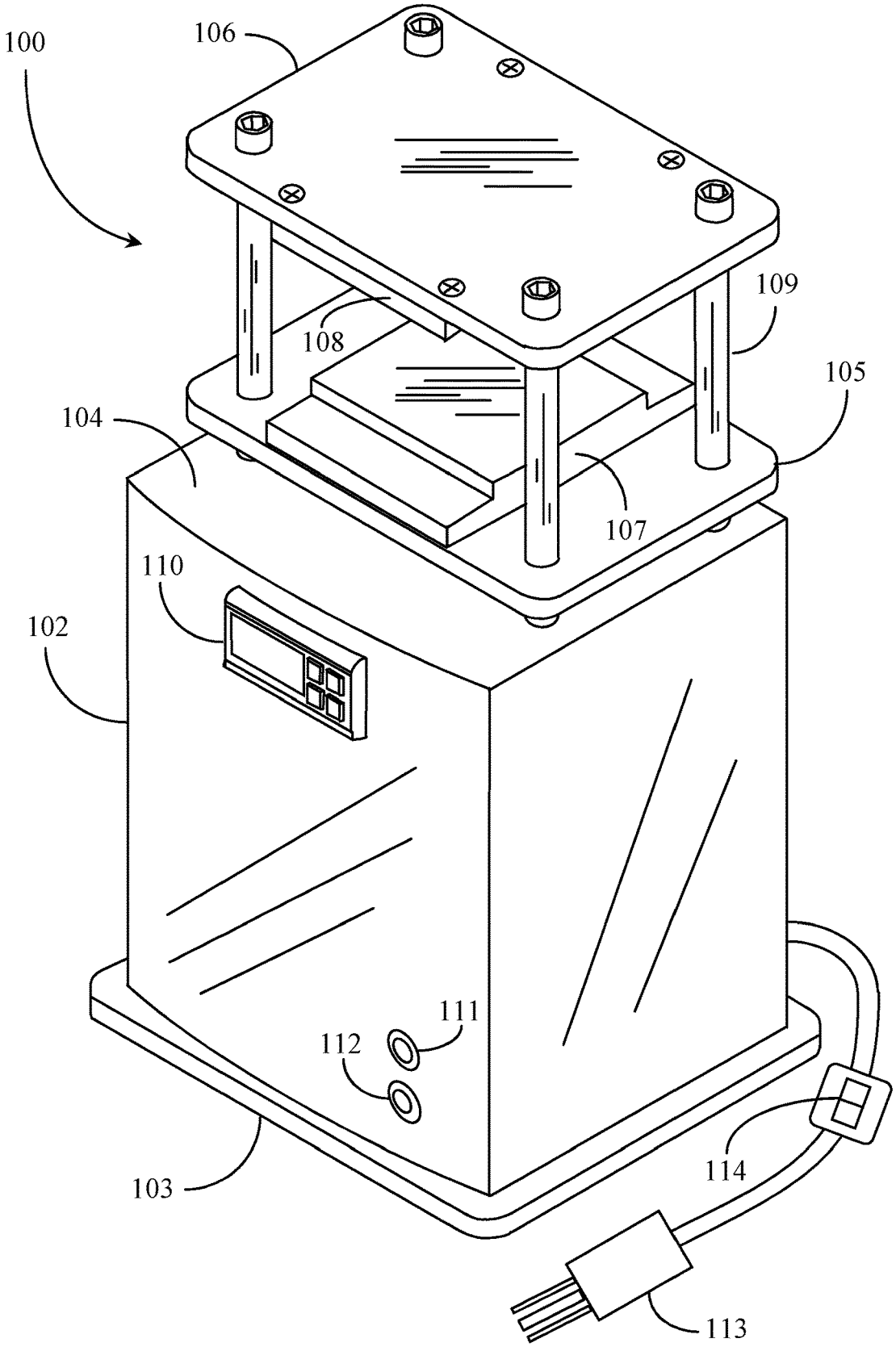
FIG. 1 is a perspective view of a linear actuated press for processing organic plant material according to an embodiment of the present invention.

FIG. 1 is a perspective view of a linear actuated press 100 for processing organic plant material according to an embodiment of the present invention. Linear press 100 is a consumer-based table top press adapted to press organic plant material under heat to separate essential extracts, oils, resins, or compounds from the plant material. Press 100 weighs approximately 13 pounds and may process up to 7 grams of organic materials each press run resulting in up to one third of the gross weight in extracted oils extracts, resins or compounds.

Press 100 includes a device housing 102 having a front side, a rear side, a left and right side, and a top panel 104. It may be assumed that housing 102 includes a floor panel though it is not required to practice the present invention. Housing 102 is fixed down over a press base plate 103 that may be fabricated of stainless steel or another durable machine material. Base plate 103 may rest on or may be mounted to a table top or bench top for consumer use. In one embodiment, base plate 103 may include legs or feet or may simply sit flat on a table.

Device housing 102 including top panel 104 may be fabricated of stainless-steel sheet metal one sixteenth to one eighth of an inch standard thickness. Device housing 102 encloses a linear actuator (not illustrated) that drives (lifts) a lower press plate platform 105 having a lower press plate 107 mounted thereon against a fixed upper press plate platform 106 having an upper press plate 108 mounted thereon. Press 100 includes a symmetrical pattern of linear press track posts 109 fixed to a press frame component or seat component (not illustrated) beneath top panel 104. Each track post 109 is held parallel and orthogonal to the press plate platforms, one post at each corner and are of equal length. Track posts 109 may be solid stainless-steel rods or thick wall stainless steel tubes and are annular in cross-section.

Lower press plate platform 105 may be fabricated of a stainless-steel plate material (or other suitable material) of perhaps three eights of an inch to a quarter of an inch thickness. Lower press plate platform 105 includes four openings, one at each corner of the platform in alignment with the same pattern as the track posts. Lower press plate platform 105 includes a lift collar (not illustrated) that makes connection (threaded on to) a linear travel screw at center underneath the platform.

The inside diameter of the track post openings in lower press plate platform 105 is held just larger (within acceptable machine tolerance) than the outside diameter of linear track posts 109 so the lower press plate platform may fit over the track posts and be urged upward toward upper press plate platform 106, which is fixedly mounted at the top of the four track posts 109. Track posts 109 and the inside surface of the track post openings through platform 105 may be coated to reduce friction and to prevent kinking or catching as the lower press plate platform travels over the track post pattern. A Teflon-based material, or any other similar non-stick material know in the art, such as thermoline, may be applied as a non-stick permanent coating to the track posts and to the post openings in lower press plate platform 106.

A linear actuator (not illustrated) drives a vertical screw with the aid of an electric motor that runs on alternating or direct current. The linear actuator may be mounted within device housing 102 centrally and beneath lower press plate platform 105. Press 100 includes a power cord with a three-pronged AC plug that fits into a typical three prong outlet 113. A cord switch 114 may be provided and installed for switching to power on or to power off. More detail about a linear actuator enabling the press function of press 100 is provided later in this specification. In a one embodiment, press plates 108 (upper press plate) and 107 (lower press plate) are machined flat to sit flush with the respective platforms and are mounted to the respective platforms via machine mounting screws. In this example, both upper and lower press plates are stepped (material removed) at the front and back sides to enable more efficient plate heating and to define the press area for placing raw material to be pressed.

Press plates 107 and 108 are heated in a preset and controlled manner during press operation. Press 100 includes a user heat control interface 110 for presetting heat level for each press plate, or in one embodiment for both press plates in tandem. Control interface 110 includes a display that displays current heat levels for each press plate to the user. The display may be a liquid crystal display (LCD), a light emitting diode (LED) display, or an organic liquid crystal display (OLED) display. The primary function of user heat control interface is setting heat level for each plate, the heat level to be maintained during press operation. Other functions may also be available through control interface 110 without departing from the spirit and scope of the invention.

Lower press plate platform 105 is operated from the front face of the press by a user selecting and pressing one of two available buttons 111 (raise plate) or 112 (lower plate) while the press is plugged in and powered on. A user may place up to 7 grams of organic plant matter onto a collection parchment sheet (not illustrated), fold the sheet over to cover the top of the plant material and place the arrangement onto the lower press plate 107 (top press surface). The user may then close the press by selecting button 111 (raise press plate) until the raw plant material is tightly pressed between the two plates. Press 100 may exert up to 1,500 pounds per square inch (PSI) on the pressed materials under heat set within a range between or about 185 degrees Fahrenheit to 210 degrees Fahrenheit. The practical heat level of one or both plates may be based upon the type of raw materials and the identification of the resins, oils, extracts or compounds sought for extraction.

Press 100 may include material preparation and collection tools (not illustrated). For example, a hand-held material compacting device may be provided so that a user may place a singular raw material plug between the parchment paper instead of dry crumble. After press, a user may remove the pressed plant matter (plug) and set the paper aside to cool before using a collection tool to scrape off the viscous extract from the paper surface. The extract, oil resin or compound melts due to the heat maintained in the press plates and is forcefully pressed out of the raw plant material. The collected extracts, oils, resins or compounds may be set left on the heavy parchment paper to cool before collection for personal use or to add to a batch amount for later use.

It will be apparent to the skilled artisan that press 100 may be utilized to extract oils, resins, extracts, or compounds and other organic compounds from a variety of raw plant materials without departing from the spirit and scope of the present invention. For example, oils may be pressed out from oil bearing plant material such as flax seed. In some examples, different ranges of plate heating may be provided for different types of organic raw plant matter bearing different compounds for extraction. In a preferred embodiment, press 100 is utilized to process flower material of a *cannabis* plant.

Figure 2:
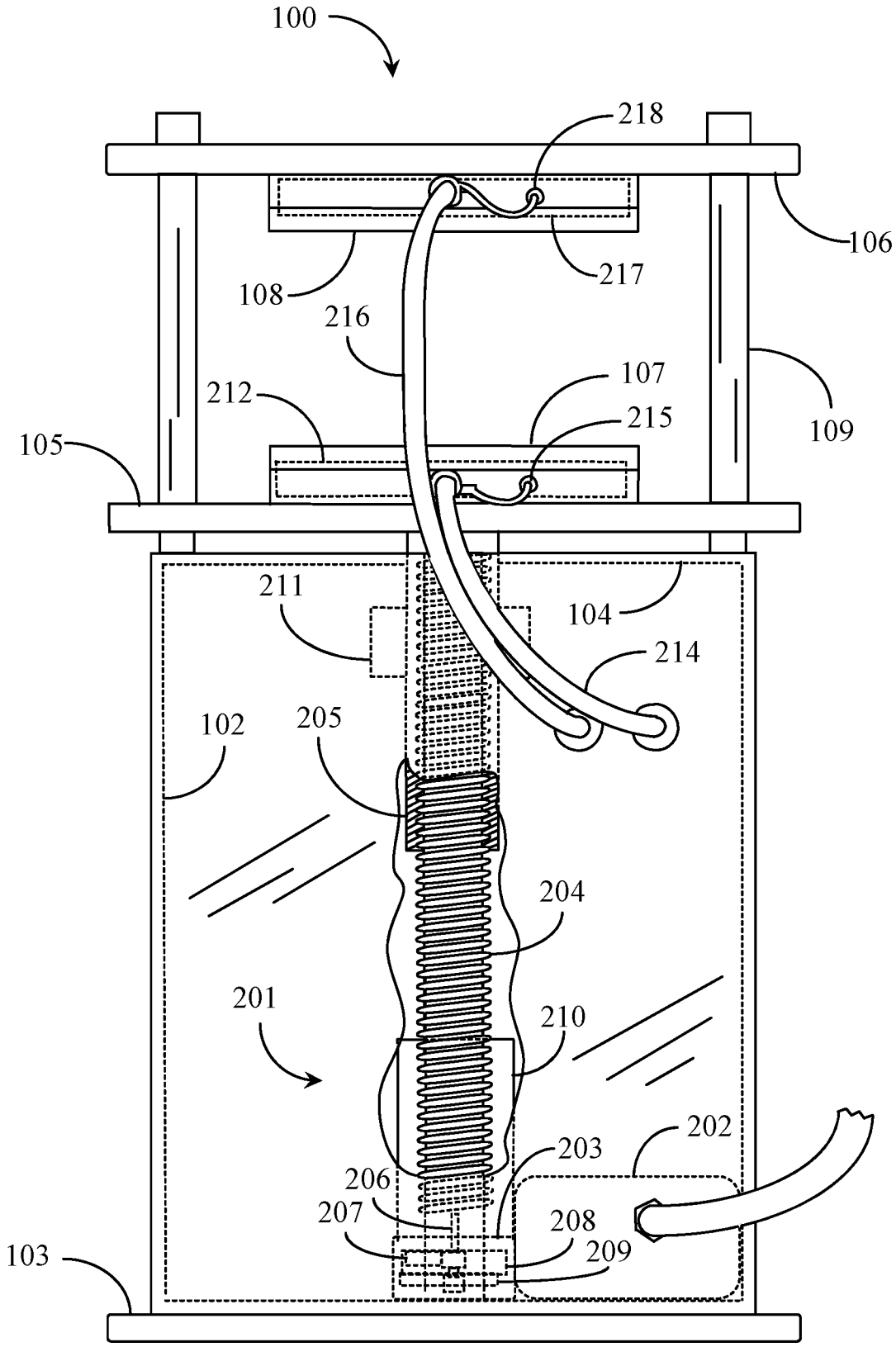
FIG. 2 is a rear elevation view of the press of FIG. 1 with a portion of the rear wall removed for clarity in description of a linear interface enabling press plate travel.

FIG. 2 is a rear elevation view of press 100 of FIG. 1 with a portion of the rear wall removed for clarity in description of a linear interface enabling press plate travel. Press 100 is viewed from the rear in this example. A power supply 202 is provided in compliance with FCC guidelines. Power supply 202 is disposed within device housing 102 and may be mounted to the floor panel of device housing 102 with a power line routed through an opening provided through the rear panel out to plug. Press 100 is driven and supported vertically by a linear actuator 201. Linear actuator 201 includes a vertical travel screw 204. Travel screw 204 may be a heavy-duty stainless-steel screw having external threads that match female threading on a lower press plate lift collar 205, depicted partly in section view at the lower end to depict thread interfacing. Lift collar 205 may be a durable stainless-steel pipe or stainless-steel tubing having internal threads matching the external threading on travel screw 204. Lift collar 205 may be attached orthogonally to lower press plate platform 105 by welding or other hardware means such as by flange mounting bracket mounting or the like. In one embodiment, collar 205 may be retained within a seat installed beneath platform 105 substantially at the center point of the platform. A through opening is provided through the center of top panel 104 at an inside diameter enough to accept the outside diameter of lift collar 205 extending into the device housing.

Travel screw 204 may be threaded into lift collar 205 to the full depth of the collar or to a specified mark or designated distance of thread involvement. Linear actuator 201 includes an actuator connection block 203. Connection block 203 comprises a steel encasement containing a gear set mounted in a planetary fashion with the gears meshed together between an electric drive motor 210 and a vertical travel screw 204, the electric motor having a drive gear 206 (fixed on motor shaft). Gears are depicted as broken rectangles in this example. Drive gear 206 meshes to a first translation gear 207 (pin mounted rotable), which in turn meshes to a second translation gear 209 (pin mounted rotable), and to a screw gear 208 fixed permanently by weld or otherwise fixedly attached to travel screw 204. Motor 210 is vertically mounted to one end of actuator connection block 203 and the base of travel screw 204 is mounted to the other end. Motor 210 may be a copper wound electric motor held substantially parallel or in line with travel screw 204.

In one embodiment, the bottom cover of actuator connection block 203 is ground flat or machined flat for flush mounting to the bottom panel of the device housing and base plate 103. (hardware not illustrated). In one embodiment, block 203 has a steel bottom cover screwed down over the block to protect the gear set inside. Connection block 203 may be mounted to position on the bottom panel of device housing 102 or directly on to the base plate (no bottom panel) using machine screws of a proper length from the bottom surface of base plate 103 mount openings may be provided through the base plate and screw head recesses to compensate for the head height of the screw.

In one embodiment, linear actuator 201 is bracketed and mounted within device housing 102 such that travel screw 204 is optimally perpendicular with the lower press plate platform 105 and may easily be threaded into lift collar 205. Motor 210 is parallel with travel screw 204 in this embodiment, however in another embodiment, motor 210 may be mounted orthogonally to the orientation of travel screw 204 wherein at least one drive gear is orthogonally oriented from a translation gear inside of connection block 203.

When motor 210 is activated to drive lift collar 205, travel screw 204 may rotate under power in either direction forward or reverse to advance lower press plate platform 105 upward to press or downward to release from press. Motor 210 may be wired to power supply 202 through actuator connection block 203 or through the motor housing. Press 100 includes necessary display and heat-set circuitry 211 to drive the user heat control interface 110 of FIG. 1. Circuitry 211 may include a small micro-controller and memory for preserving press settings, and for displaying information for the user in addition to plate temperature readouts. In one embodiment, the display screen associated with user heat control interface 110 is a touch screen and can be manipulated with touch input by a user to force display of other information such as time, date, ambient temperature, etc. Circuitry 211 may be wired to power supply 202 within the device housing (wires not visible).

Lower press plate 107 includes a heating element or plug 212 embedded within the plate. A power wire 214 is provided and connected to heating element 212 through a wall of lower press plate 107. A feedback sensor wire 215 may be connected to an embedded thermocouple or other temperature sensor. In this way current temperature readouts for lower press plate 107 may be displayed for view on the display screen of heat control interface 110. Other temperature sensing devices might also be used in place of a thermocouple without departing from the spirit and scope of the present invention. Similarly, a power wire 216 is provided to heat an embedded heating element 217 within fixed upper plate 108. A sensor wire 218 may connect to an embedded thermocouple. Sensor feedback wires 215 and 218 may be routed inside the device housing to circuitry 211 for read out. A power line may be routed from power supply 202 to circuit 211 for powering on and enabling user input to set temperatures and to read out temperatures at heat control interface 110.

Figure 3:
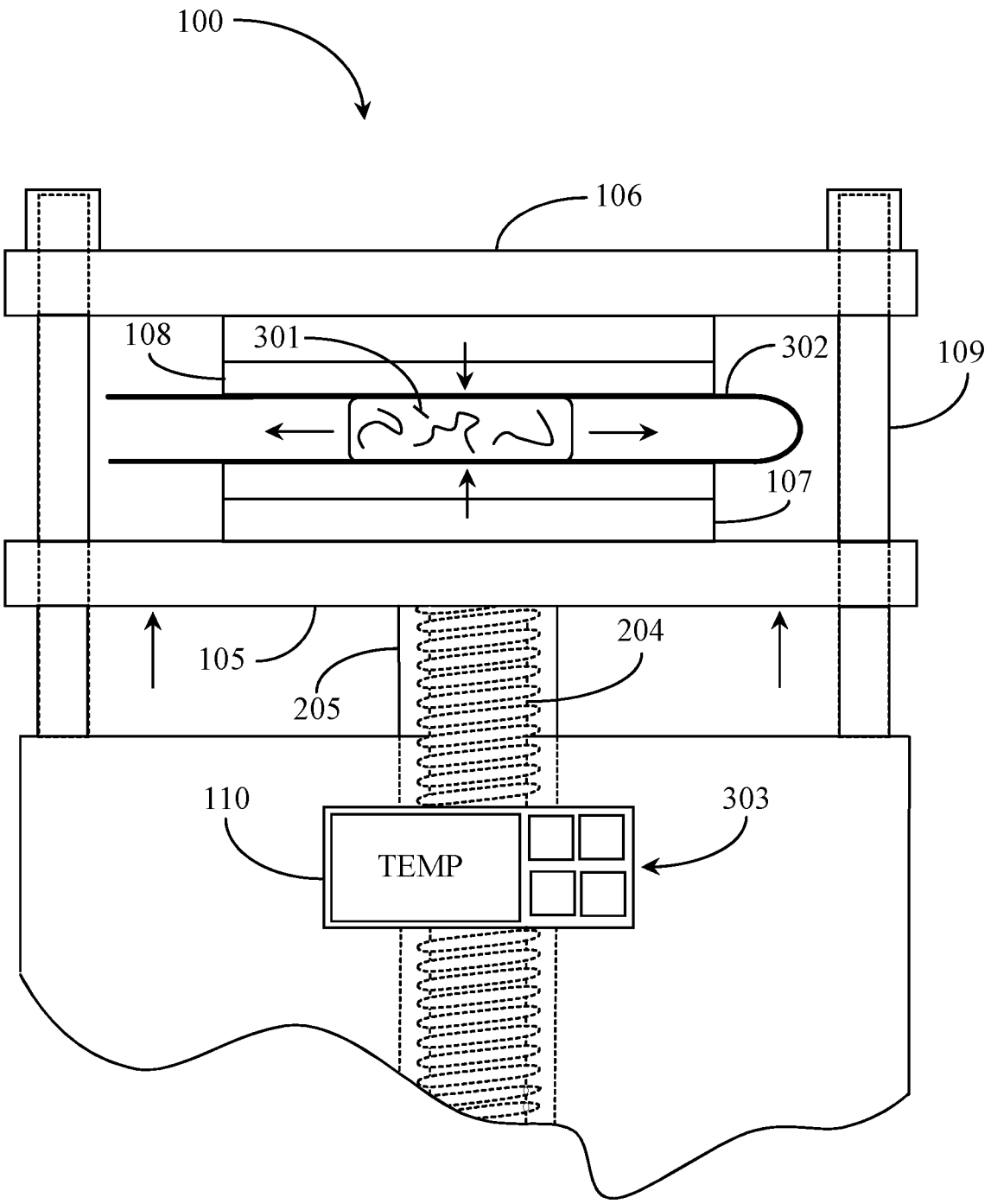
FIG. 3 is an enlarged view of the press parts of the press of FIG. 1 engaged in pressing material according to an embodiment of the present invention.

FIG. 3 is an enlarged view of the press parts of press 100 of FIG. 1 engaged in pressing material according to an embodiment of the present invention. In one embodiment, a user may place a prepared batch of raw plant material embodied herein as a compacted *cannabis* plug 301 between the fold of a large section of heavy parchment paper 302. A compact plug of *cannabis* at a level of humidity preventing dry crumbling is preferred raw material for pressing. A hand-held tube press or similar hand-held compacting device (none illustrated) may be provided to aid in compacting the plant material into a form for pressing. In another embodiment, a raw material for pressing may be moist and pliable such that a user may compact and shape it for press by hand.

It may be noted herein that compacting *cannabis* or other raw materials prior to pressing the materials is not required in order to practice the invention as the raw material may be dry crumble and may still be pressed. However, in a preferred embodiment up to 7 grams of *cannabis* having a level of humidity that enables compaction of the material is desired. One reason for compacting the material before pressing is that particulate matter crumbled or displaced from the raw material may inadvertently become mixed with the pressed and melted viscous extract that is forced peripherally out of the raw plant material under press of approximately 1,500 PSI. Therefore, the presence of a uniform shaped plug greatly reduces the occurrence of contaminate particles entering the melted extract, which flows beyond the perimeter of the plug in a state of pressed.

Lower press plate 107 (moving plate) and upper press plate 108 (stationary plate) may be individually heated as previously described above using heat control interface 110. An arrangement of buttons 303 (four buttons) may be manipulated to scroll to a desired temperature setting for one or for both plates and lock the temperature in as heating instruction for the heating elements. The display screen may display the selected temperature for set and then may display the current temperature of the plate or plates wherein as the plates continue to warm the readout continues to display gradually higher temperatures until the desired temperature is reached. In one aspect, the top two control buttons 303 may be used to set temperature for the top plate while the lower two set temperature for the bottom plate.

Temperature may be changed by the user during press for one or both press plates by manually overriding the settings to raise or lower current plate temperatures. In a preferred embodiment for pressing *cannabis*, a temperature range from 185 degrees Fahrenheit to approximately 210 degrees Fahrenheit may define a broad "melt window". A user may experiment and make determinations based on empirical data and strain including "content" of cannabinoids like Tetrahydrocannabinol (THC) and Cannabidiol (CBD).

Figure 4:
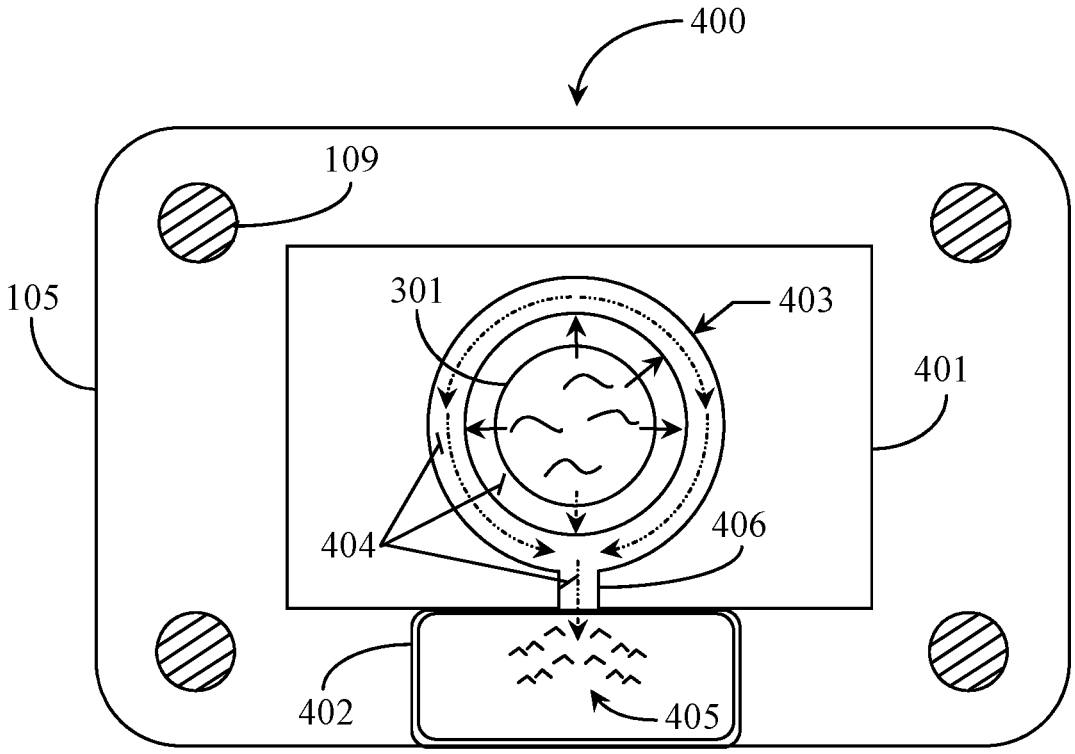
FIG. 4 is an overhead view of a lower press plate and platform assembly according to another embodiment of the present invention with the upper stationary plate and platform removed for clarity.

FIG. 4 is an overhead view of a lower press plate and platform assembly 400 according to another embodiment of the present invention with the upper stationary plate and platform removed for clarity. Assembly 400 may include lower press plate platform 105 slidably mounted over track posts 109 depicted as sectioned off in this view. In this example, a lower groove plate 401 is provided in place of the lower press plate 107 of FIG. 3. Groove plate 401 may or may not be stepped to reduce mass for heating. Groove plate 401 may be three eights of an inch to one half of an inch in thickness. Groove plate 401 may be machined or otherwise fabricated with a groove 403 functioning as a resin deposit boundary disposed around the press surface area of the groove plate.

Groove plate 401 performs essentially the same function of press plate 107 during a press and heat process. However, in this embodiment a parchment paper is not required between material plug 301 and press surfaces. Groove 403 may be a rectangular groove having two vertical walls and a flat groove bottom. In one embodiment, groove 403 may be fabricated with a rounded groove bottom. In this embodiment groove 403 is a circular groove pattern however, other geometric groove patterns may also be utilized without departing from the spirit and scope of the present invention. In one aspect, the groove pattern may be an ellipse, a triangle, a rectangle, a trapezoid, or another shape.

In a preferred embodiment, groove 403 is fabricated or machined to be gradually deeper over distance from a relatively shallow point off the rear of the press surface to a deepest point at the opposite side of the groove pattern. Groove 403 includes a melt groove exit chute 406 that intersects orthogonally with groove 403 toward the front of the press plate and channels viscous melt compounds oils, extracts, or resin toward the front and center of the linear press. In one embodiment, groove 403 has a slope angle having a minimum depth (from press surface to groove bottom) at the rear of press plate 401 and a maximum depth at the front of press plate 401 where chute 406 begins. Exit chute 406 may have a much sharper slope angle of groove bottom to speed up the flow of viscous oils, resins, compounds, etc. out of groove 403 and into a collection tray 402. In one embodiment, a nonstick surface 404 may be applied to the press surface beneath plug 301, the interior of groove 403 and groove melt exit chute 406. There is a wide array of heat resistant and non-gassing Teflon surface coatings available in the art and known to the inventor that may be applied.

Collection tray 402 may be a stainless-steel tray with a non-stick coating, such as a Teflon or thermolon, applied on the bottom and inside walls of the tray. Viscous material 405, depicted inside tray 402, travels from plug 301 under press force with the press plates heated into groove 403, down groove 403 to the front behind exit chute 406 and into tray 402. A user may press many plugs sequentially without breaking to collect resin, extract oils or compounds from individual collection papers. Product 405 may be left in tray 402 to cool and to be further processed or stored for use. Tray 402 may have a top cover in one embodiment though a cover is not illustrated in this example. In one embodiment, tray 402 may be placed on press plate platform 105 in front of exit chute 406. Plate material may be removed from the forward side of press plate 401 in the area of tray 402 by milling so that a user may tuck tray 402 just under exit chute 406 so that the exiting material may drip or flow out and directly into tray 402 without coming into contact with a tray wall.

Figure 5:
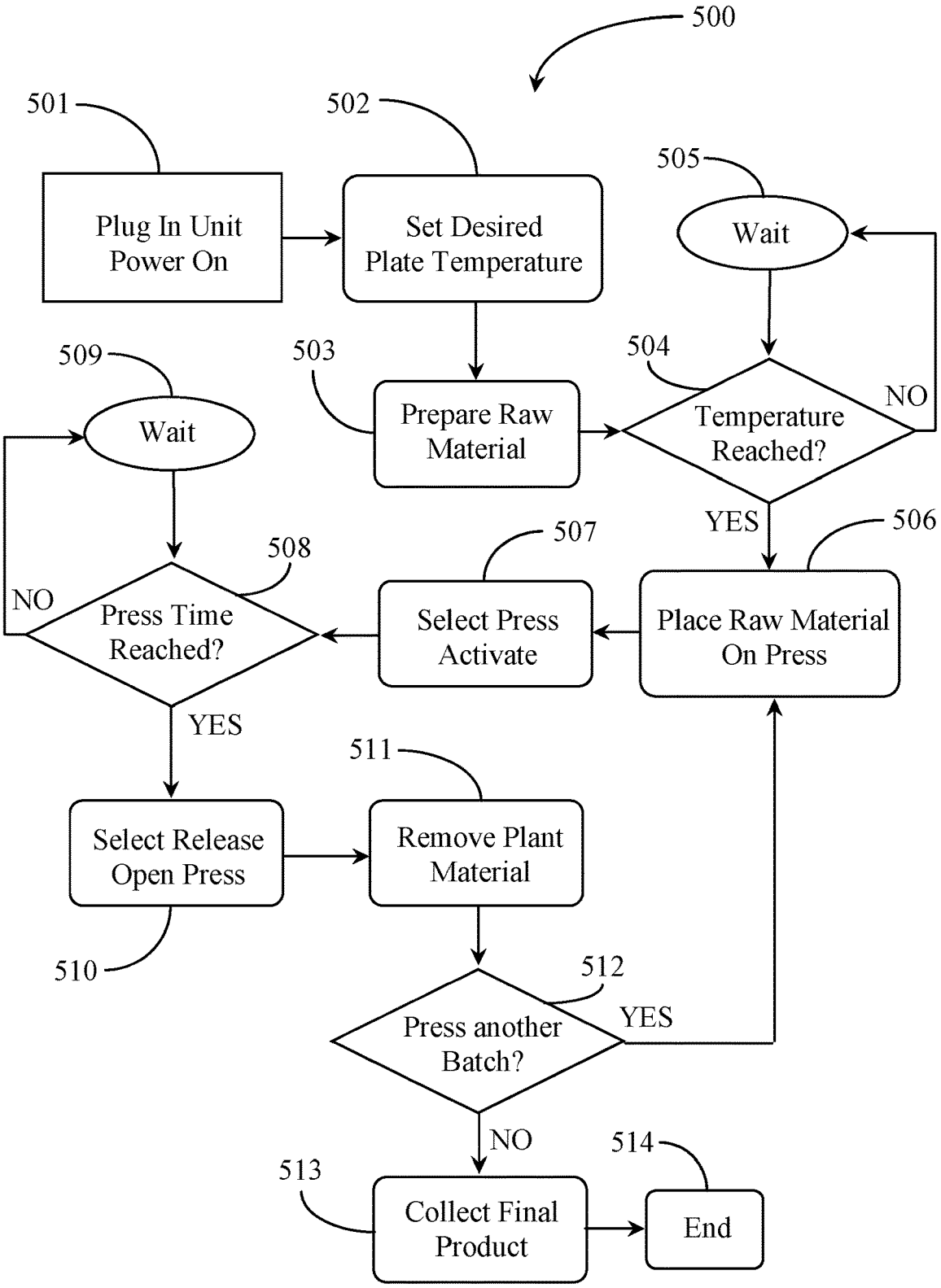
FIG. 5 is a process flow chart depicting steps for preparing and pressing organic material to extract viscous materials using the linear actuated press according to one or more aspects of the invention.

FIG. 5 is a process flow chart 500 depicting steps for preparing and pressing organic material to extract viscous materials using the linear actuated press according to one or more aspects of the invention. In step 501, a user may plug in the linear press unit analogous to the units described previously. The press unit typically has a three-pronged AC plug and may have a switch for power on power off on the cord itself or on the unit. Also, in step 501, the unit may begin heating the press plates automatically according to the last user heat settings. At step 502, a user may set desired plate temperatures for heating the raw plug material while pressing the material. Step 502 may be skipped if the user does not which to apply different temperature settings than those already programmed into the unit. A user may set the maximum temperatures for each press plate individually in one embodiment. In another embodiment, one setting affects both press plates and they maintain the same temperature set by the user.

At step 503, a user may begin preparing raw material such as *cannabis* for pressing. It may take a small amount of time for the press plates to attain the desired press temperature. Step 503 may be practiced in the interim. In one aspect, a user may form a *cannabis* plug up to 7 grams of weight by hand or with a hand-held compactor and insert the formed plug between a fold of parchment paper, so it is covered on top and bottom sides. At step 504, the user may determine if the press temperature set by the user in step 502 has been reached. At step 504, if the press temperature has not yet been attained then the process may loop back to step 505 to wait and back to step 504 to make the determination again. In one aspect, the screen associated with the user heat control interface displays the temperature graduation as it occurs through reporting of sensor feedback data to the display from thermal sensors in the plates.

If at step 504, the user determines that the press plates have attained temperature and the linear actuated press is ready for use, the user may place a parchment paper containing a plug of raw material onto the lower press plate surface at step 506 to be pressed. In one aspect wherein, the lower press plate is grooved, the user places a plug directly onto the lower press plate surface within the interior of the groove pattern. At step 507 the user may select a press activate button analogous to lift button 111 of FIG. 1 (press lift button) to cause the lower press plate and platform assembly to travel upward to bring the press plate surfaces together under force of 1,500 PSI or greater.

At step 508, a user may decide whether an appropriate press time was reached (time that press plates are closed). The press time may be determined by the user visually having experience making prior press runs with the same material. In one aspect, a timer may be automatically set by the unit based on the amount of material placed on the lower press plate surface and the actual temperature of the plates. A sensor may be provided in the press plate surface that detects the presence of the raw material placed on the surface and reports the weight or otherwise estimates the weight of the material plug. The variables may be used by an algorithm running on a small micro-controller in circuitry controlling the display. In that embodiment a visual notification of the expiration of a complete press time may be displayed to the user. If the press time has not been attained at step 508, the user may wait at step 509 until a notification or sound occurs. If at step 508, the user has determined that the press time is completed, the user may select and depress a release button to open the press at step 510. In one aspect, the user may open the press at any time after or before a press time has completed wherein the release button analogous to button 112 of FIG. 1 overrides any programming for safety purpose.

In one aspect of the method, a distance may be preset by the user using the control interface analogous to interface 110 of FIG. 1, the distance defining a maximum gap between the press plates when not pressed together. In that aspect, the lower press plate may automatically travel down to a stop when the user depresses a release button. In still another aspect, the user may place the material on the surface and press the lift button to start the press operation. Thereafter, the unit may calculate the appropriate press time based on heat of the press plates and weight of material, press the plates together and hold them at 1,500 PSI for the duration of the calculated time, and then release the lower plate down to the preset stop.

At step 511, the user may remove the pressed plant material. In one aspect, the user removes the pressed plant material from the parchment paper and any unwanted particulate. The oily wax or resin extracted is pressed out of the plug and forms a liquid (highly viscous) ring about the footprint of the pressed plug. In one aspect wherein, the plant material was placed on a lower groove plate, the user removes the plant material from the lower press plate surface and the oily wax or resin melt flows into the groove.

At step 512, the user may determine to press another batch of raw plant material. If the user determines to run a next batch of material at step 512, the process loops back to step 506 where the next batch may be placed on the lower press plate surface. If the user is done pressing at step 512, the user may collect final product at step 513 and the process ends where pressing is concerned at step 514. In one aspect, final product is scraped off the parchment papers with a provided scraping tool. In another aspect wherein, the lower press plate is grooved, the material may be deposited from the melt groove into a collection bin or tray. A cool down period may be observed before scraping the material off parchment paper.

A mechanical press means architecture may include a base platform as a means for support, a means to house the internal components and circuitry like a device housing secured centrally over the platform base plate, the device housing having an upper means of support such as a top panel. The architecture may accommodate an electric drive and press means for lifting the lower press plate to an upper press plate like an electric linear actuator assembly disposed within the device housing.

A means for lifting the lower platform may be enabled by providing a motor driven travel screw hosting a lift collar threaded over the screw and fixed to the platform. A means for aligning the platforms and press plates is enabled by two or more vertical track posts having a uniform length and diameter arranged and spaced apart symmetrically, the track posts mounted to the device housing defining a track for the lower press plate to follow and functioning as a lift track for the lower press plate platform.

Means for heating the press plates may be enable by providing electric heating elements, wherein a first electric heating element is embedded into the lower press plate and a second electric heating element is embedded into the upper press plate, the first and second electric heating elements including at least one feedback sensor to report temperature. Means for controlling the heat of the press plates may include a heating control interface and display and drive circuitry, whereas means enabling a user to lift and lower the lower press plate may be provided as a press activation user interface including at least an electric button for raising the lower press plate and an electric button for releasing the lower press plate. A means for power distribution to the internal electric components of the press may be enabled by a power supply module that has a cord out through the device housing to an AC plug-in outlet and wiring routed within the device housing to connect the motor, the heating elements and temperature sensors, the display circuitry, and the user heat-control interface.

Figure 6:
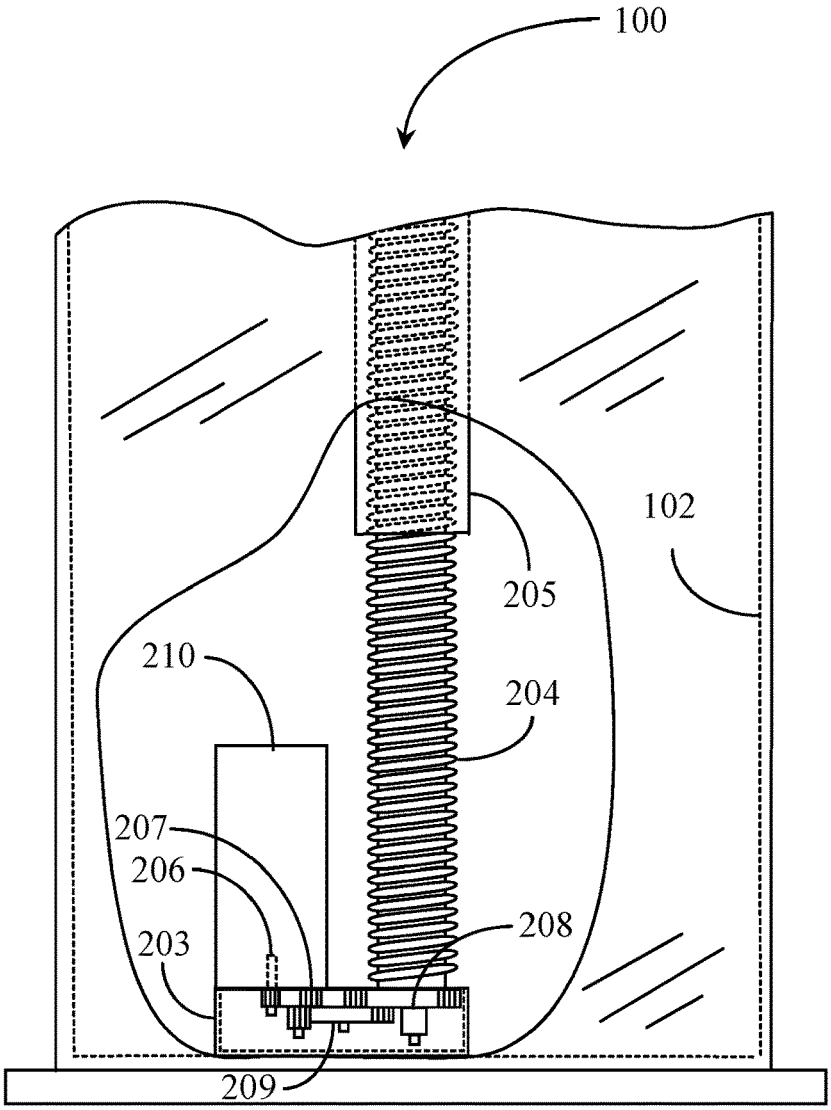
FIG. 6 is a partial right-side view of the press of FIG. 1 with a portion of side panel removed to depict internal actuator components.

FIG. 6 is a partial right-side view of press 100 of FIG. 1 with a portion of side panel removed to depict internal actuator components. Press 100 has the top portion removed and a portion of side panel removed to depict a side view of linear actuator 201. Linear actuator 201 includes motor 210, actuator connection block 203, and vertical travel screw 204. Actuator connection block further has a side wall removed for clarity. Lift collar 205 is fixed to the lower platform assembly and travels up or down travel screw 204 as the travel screw is rotated. Motor 210 is mounted vertically in line with screw 204 on the opposite side of actuator connection block 203 from screw 204. In this view the front of press 100 is to the right of travel screw 204.

Motor 210 includes motor shaft 206 with a fixed gear to drive travel screw 204. Gear 206 aligns with and meshes with first translation gear 207. Gear 207 may be mounted on a vertical gear pin within the actuator connection block 203 and is freely rotable. Gear 207 has two gear mesh diameters that mesh with second translation gear 209, which has a larger overall diameter. Gear 209 may also be pin mounted within block 203 and is freely rotable. Travel screw 204 includes a fixed gear 208 that meshes with translation gear 209. Actuator connection block 203 may be screwed down into position from the bottom surface of the lower press plate platform.

The exact orientation of actuator connection block 203, and motor 210 may vary from this configuration without departing from the spirit and scope of the invention. One with skill in the art of linear actuation may appreciate that motor 210 may be mounted orthogonally from travel screw 204 or at an angle off travel screw 204 without departing from the spirit and scope of the invention. The gear set number (of gears) and the orientation thereof may be changed to accommodate alternate motor positions. It may be noted herein that in one embodiment, there is a device housing frame to which panels may be assembled to creating device housing 102. Bracketing and other mounting hardware may be assumed present though none is specifically illustrated.

Figure 7:
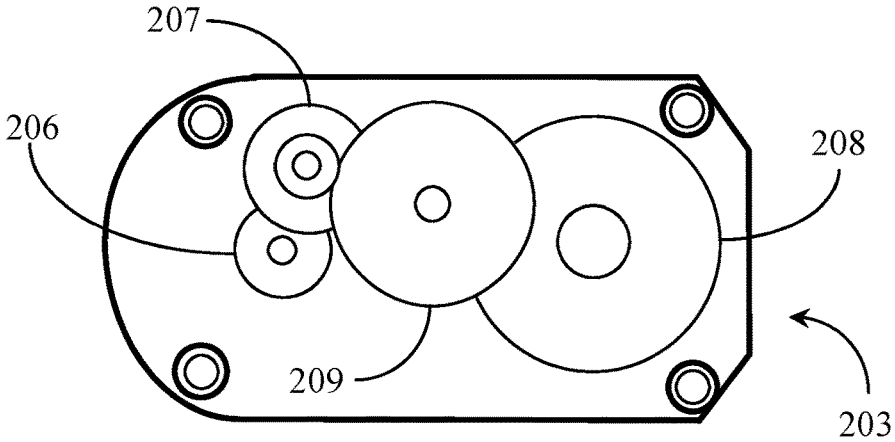
FIG. 7 is a bottom view of the actuator connection block of FIG. 6 with the bottom cover plate removed to depict gear orientation.

FIG. 7 is a bottom view of actuator connection block 203 of FIG. 6 with the bottom cover plate removed to depict gear orientation. Actuator connection block 203 includes the planetary arrangement of gears, 206 (fixed motor shaft), 207 (pin mounted translation gear), 209 (pin mounted translation gear), and 208 (fixed travel screw gear). Perimeter gear meshing is not depicted in this view for each gear 206-209 but may be assumed present. In this embodiment, motor 210 drives travel screw 204 through the gear set within actuator connection box 203. In one embodiment motor 210 maybe a single speed motor. In one embodiment, motor 210 may be adapted to operate at variable selected speeds without departing from the spirit and scope of the present invention. In this embodiment, actuator connection block 203 has a set of gears that produce a static torque enabling travel screw to force a load of 1,500 PSI on the press plates. In another embodiment of the invention there may be an alternate gear and a mechanical gear selector to switch from two different gears to create two different force settings for the press plates without departing from the spirit and scope of the invention.

Figure 8:
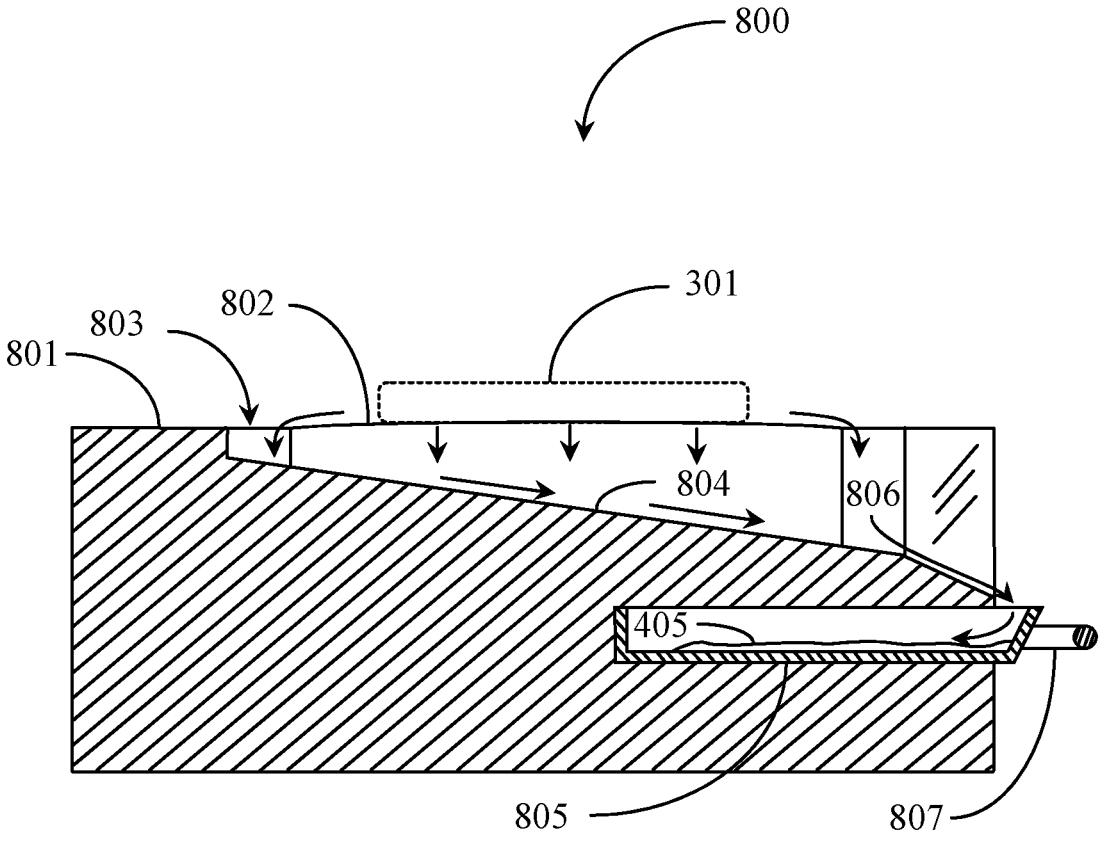
FIG. 8 is a sectioned side view of a lower groove plate 800 with a graduated flow path for viscous material according to an embodiment of the present invention.

FIG. 8 is a sectioned side view of a lower groove plate 800 with a graduated flow path for viscous material according to an embodiment of the present invention. Groove plate 800 is like groove plate 401 of FIG. 4, but includes one or more features not introduced in the groove plate of FIG. 4. Groove plate 800 has a top surface 801 defining the top flat ground or milled surface outside of the groove feature. Groove plate 800 includes a press plate surface 802 that is higher in elevation than flat surface 801. During a press operation involving the upper stationary press plate analogous to press plate 108 of FIG. 1, there may be a small gap between surface 801 and the corresponding surface of the upper press plate.

Press surface 802 may be milled or ground as a convex surface highest at center and graduating down toward the groove feature. The corresponding press plate may be milled or ground to have a concave press surface that substantially matches the lower press plate press surface. Raw material plug 301 is depicted in broken boundary for reference. In this sectioned view, a groove feature 803 like groove feature 403 of FIG. 4 is depicted from the left side of the press unit. Groove feature 803 follows an annular groove pattern that slopes down toward the front of the press unit. The slope angle may be approximately 20 degrees from horizontal.

Groove feature 803 includes a melt exit chute 807 that provides passage of melted oils, extracts, or viscous compounds from the groove feature 803 into a collection tray 805.

Collection tray 805 may be inserted into plate 800 in the fashion of a drawer. Tray 805 may include a tray handle 806 enabling a user to insert the tray into plate 800 and to pull it out of plate 800. Groove plate 800 is a heated plate like groove plate 401 and functions to melt the desired essential components in the raw material as it is being pressed. The function of convex surface 802 is to enable a lesser path of resistance for viscous material to squeeze out of plug 301 and down (effected by gravity) into groove 803 as indicated by the direction of the directional arrows emanating from surface 803. The slope angle of groove feature 803 enables a path of least resistance for the viscous compound to flow toward the front of the press plate to melt exit chute 807. The slope angle of exit chute 807 is significantly larger than the slope angle of groove feature 803. For example, groove feature 803 may have a 20-degree slope angle whereas the exit chute has a 30-degree angle out of the press plate.

Collection tray 805 may be a stainless-steel tray having a bottom wall and four side walls and a depth enough to accommodate a buildup of materials 405 deposited therein. In this view, the part of groove feature 803 nearest the viewer is revealed as well as the exit chute 807. In one embodiment, press surface 802 has a conical shape culminating at a high center point and a surrounding gradient surface that slopes the same angle down to groove feature 803. In one embodiment, small radial feeder grooves may be machined into surface 802 in a spoke pattern emanating from near the edge of the plug 301 and breaking out into the groove feature 803.

The heating control interface maintains heat stability to plate 800 maintaining a stable (non-deviating) melt heat for surface area 802 and groove feature 803 in as much that viscosity in the melted compound is important to enable the compound to continue to flow down the groove and into the collection tray 805 underneath exit chute 807. Collection tray 805 may also be a heat target at least to the maintenance of compound viscosity within the tray enabling flow to the rear portions of the tray. In one embodiment, there may be more than one ceramic heating element provided to groove plate 800. For example, an element and sensor may be provided to heat the press plate surface 802 and groove 803, while a separate element and sensor might be provided and enabled for tray 805. In such a case, tray 805 may be programmed to be maintained at a same or lower heat level than the press surface level. In one embodiment, material 405 in tray 805 may be allowed to accumulate and cool to a degree that enables a user to take product from the tray and place it in another device for consumption.

In one embodiment of the invention, a sampling chamber or compartment (not illustrated) may be provided within the interior of lower groove plate 800 in an area near enough to groove feature 803 for some of the melted extract to flow into it through a passageway drilled or otherwise machined into the compartment from the groove feature. A sampling chamber may be a small pocket placed just under the rear center portion of groove feature 803. A small opening may be drilled into the pocket from the groove to allow some melted compound to seep through into the pocket. Another passage into the pocket can be provided through the plate material from the rear side of the plate to enable a user to smoke vapor formed in the pocket with an attachment adapted for the purpose.

A carburetion opening may be provided into the pocket from surface 801 or from the rear to assist evacuation of vapor formed in the chamber. A separate heating element may be provided for heating the sample chamber that may attain a level of heat high enough to vaporize the contents allowing a user to taste a melted compound within a time frame of a first press run. In this embodiment, the sample chamber may benefit from the general heat provided by the element adapted to heat the press surface and the groove but may be heated by separate element at will by a user operating a fire button provided and adapted for the purpose.

In one embodiment having a sample chamber, the sample chamber passage to the groove is always open and material fills the pocket up to the groove. The action of heating the sample chamber to vaporize product may be repeated at will during press operation. Tools maybe provided to clean the press parts, collection tray and sample chamber. In another variation of the embodiment having a sample chamber, the passage from the groove to the sample chamber may be manually closed so that no melted compound enters the sample chamber.

Modular Platform

In one embodiment, the inventor provides a modular press-plate platform for incorporation into a machine press operation including upper and lower matching press plates. For the purposes of discussion, a press plate platform shall be defined as a matching pair of press plates and the supporting interfacing elements including heating and temperature sensing hardware and electronic interfaces for controlling the application of heat.

A goal of the invention is to provide a means to extract liquid extract out of a raw material by a combination of physical press force expressed in pounds per square inch (PSI) and generated heat using said plate platform. One goal of the present invention is to provide a means to extract a liquid from raw materials in the form of a modular press plate platform and supporting hardware and, in one embodiment, control interface that can be installed on a standard press machine, for example, replacing the existing press plates and control nodes.

Another goal of the invention is to provide a means such as a groove or flow channel in at least one of the press plates and a means to strategically and efficiently (relative to time and yield amount) direct the pressed liquid extract from the press surface through the groove or channel and into a collection vessel. Still another goal of the present invention, is to provide a heated and grooved press plate platform that may be scaled up in size and shape or footprint to fit press machines having larger press force capacities and larger press volume capacities relative to raw material pressed in a single operation. The present invention is described in enabling detail using the following examples, which may describe more than one relevant embodiment falling within the scope of the present invention.

Figure 9A:
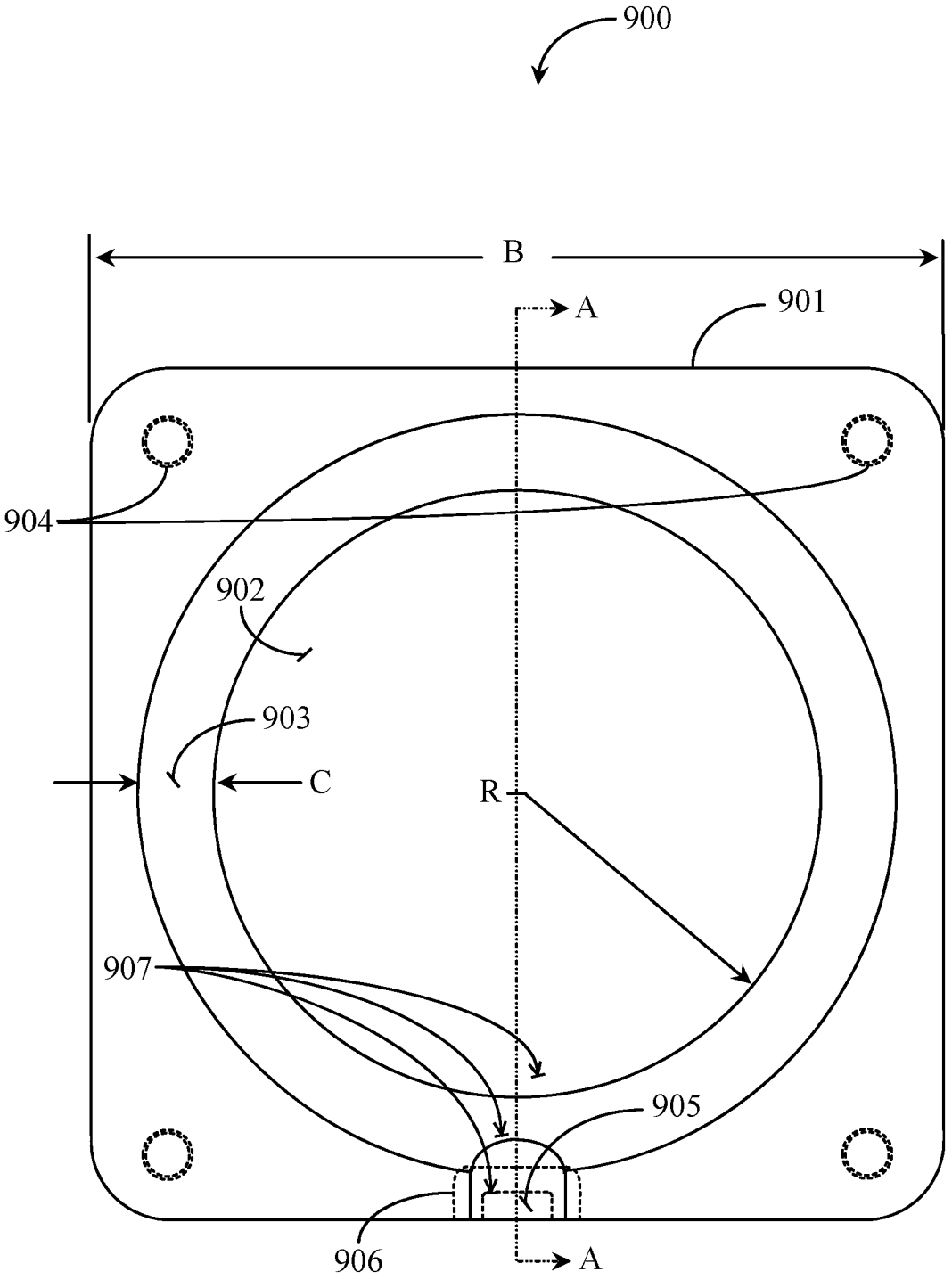
FIG. 9A is a top view of a grooved platform press plate according to an embodiment of the present invention.

FIG. 9A is a top view of a grooved platform press plate 900 according to an embodiment of the present invention. Grooved press plate 900 represents a lower press plate in a vertically oriented press plate platform also including an upper press plate described later in this specification. Grooved platform press plate 900 may be referred to as groove plate 900 in this specification. Groove plate 900 may be fabricated of anodized (surface hardened) aluminum or another metal like a hard steel that may transfer applied heat evenly to raw material being pressed. One option is steel though heating requirements may be different for the different metals considered based on thermal conduction properties associated with the metal. It is also noted that the metal used to fabricate groove plate 900 is not susceptible to warping under a state of applied heat to the plate of up to and over 200 degrees Fahrenheit. It is further noted herein that more than one metal may be used to fabricate groove plate 900 without departing from the spirit and scope of the invention. Materials may be layered over one another to form groove plate 900 such as a steel overlaid by an anodized aluminum cover plate that may include the groove feature without departing from the spirit and scope of the present invention.

Groove plate 900 has a form 901, which in this example, is a rounded rectangular form having a width/length dimension B for a square form. Dimension B may range from approximately 8 inches up to thirty-six inches or there about for application to gradually larger press machines such as commercial grade machines designed to press more than one half pound or so of raw materials. Groove plate 900 may be mounted on to a base platform of a vertical press machine from below the base platform using mounting screws that fit through the lower base platform plate into threaded openings 904 on the rear side of the plate in this view. Referring now to FIG. 4 of the specification groove plate 900 may mount on a lower press platform of any press machine such as press platform 105 of press machine 100 depicted in FIG. 1.

Referring now back to FIG. 9A, groove plate 900 has a press surface 902 taking up a footprint represented in this example by radius R. In this example, press plate surface 902 occupies a higher plane in elevation than the rest of the top surface of groove plate 900 to focus PSI from the press machine onto the press footprint on which the raw material is placed for press. In this implementation, groove plate 900 includes a circular groove 903 that functions as a circular flow channel or moat structure to capture liquified extract escaping press surface 902 and to direct the extract off the plate. Groove 903 has a groove width C deemed appropriate for channeling liquid extract or oil off the press surface 902. The actual dimensions R (radius of press surface) and C width of groove 903 may depend upon scaling options relative to press machine capacity and size of raw material plug or bale (commercial application) for one press operation.

Referring now to FIG. 8, groove plate 401 is mounted on center of lower platform 105. A raw material plug 301 is depicted in simulated press and the directional arrows depict the direction of liquified extract flowing peripherally outward of the pressed material and into groove 403. Groove 403 depicts the flow of material via directional arrows from the rear portion of groove 403 to the front portion of groove 403 and then off the plate 401 through an egress chute or exit groove 406 and then into a collection tray 402 as final material product 405. Referring now back to FIG. 9A, groove 903 has a radiused groove bottom as opposed to a flat bottom groove depicted in a sectioned view in FIG. 8 of grooved plate 801.

In a preferred implementation, groove 903 may be shallow at the center rear point in the groove and may gradually deepen in both directions of the groove following a predetermined grade or slope of 10 to 15 degrees. The radiused bottom of groove 903 provides a more efficient flow surface for the melted extract. Therefore, groove 903 is deepest at the center front portion of groove 903 where it breaks out into a material egress or exit groove 905.

Material exit groove 905 may intersect groove 903 orthogonally and may have a radiused bottom. Exit groove 905 may be maintained at a lower elevation than the bottom of groove 903 at the deepest point such that extract flowing from both directions of groove 903 cascades downward urged by gravity into exit groove 906. Exit group 906 may have the same width dimension as groove 903. Exit groove 906 may also follow a downward slope or grade along the bottom of the groove off the edge of the groove plate. In one embodiment, the surfaces of press surface 902, groove feature 903, and groove feature 905 are coated with a Teflon based non-stick material to discourage bonding between the essential oils and the plate/groove surfaces.

It is noted herein that raw materials may comprise ground flower material from a marijuana plant or a hemp plant where the extracted oil may include the cannabinoids associated with the strain of raw material. It may also be noted herein that raw materials may be placed in a filter sack or cover that allows the pressed oils to escape through the filter material but retains the plant matter within the filter material. The filter material may be a sturdy plastic or synthetic material that may exhibit a low liquid absorption characteristic for oil.

Figure 9B:
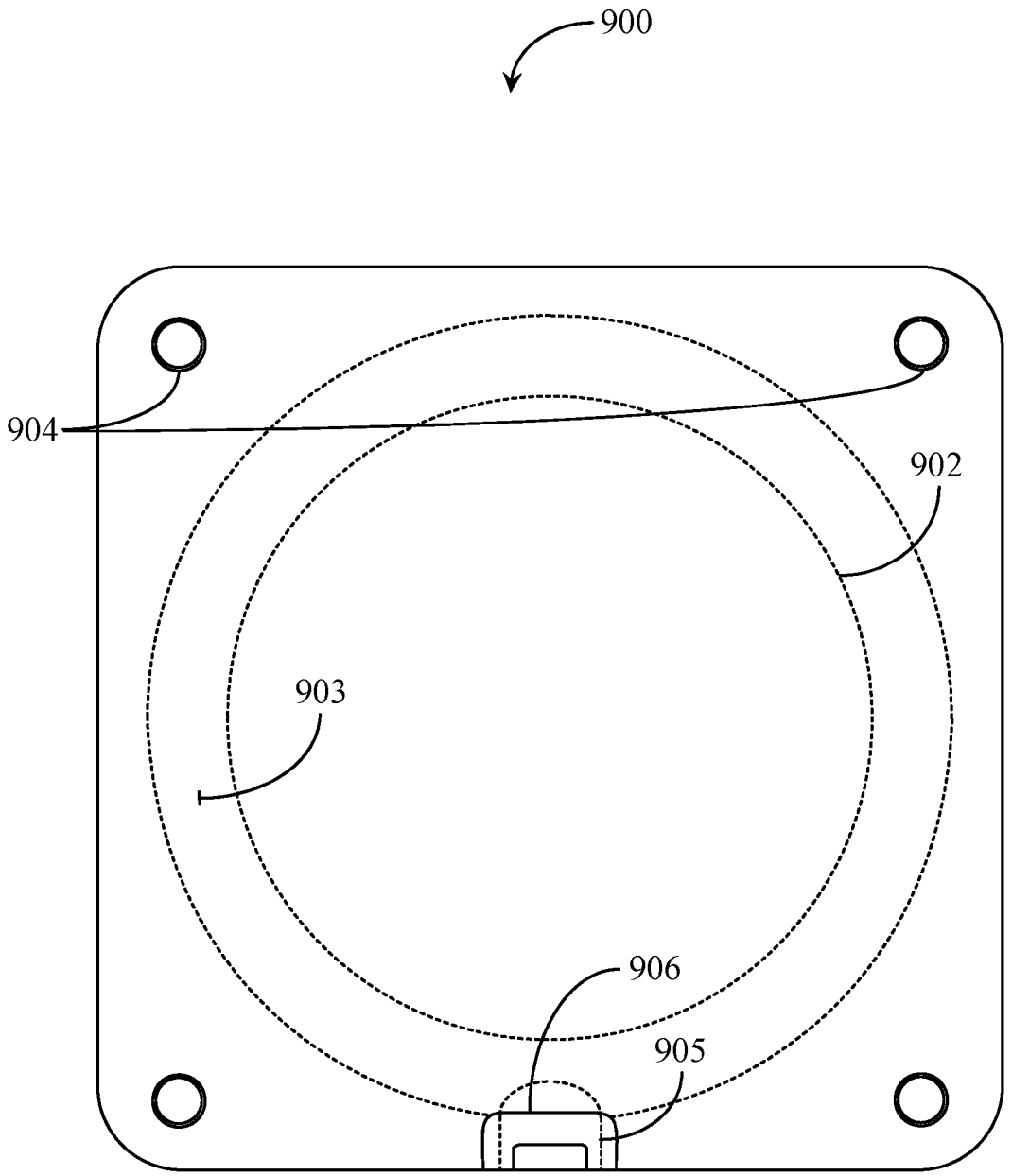
FIG. 9B is a bottom view of the grooved platform press plate of FIG. 9A.

FIG. 9B is a bottom view of grooved platform press plate 900 of FIG. 9A. The bottom surface of groove plate 900 in this example is flat. Press surface 902 and grooves 903 and 905 are depicted in broken lines. Mounting openings 904 (four each) may be blind holes that are threaded to accept mounting screws. Groove plate 900 may include a third groove feature provided at or proximal to the front and center portion of the plate visible from the bottom side of the plate. This feature may align beneath exit groove 905 shown in broken lines. Groove feature 906 prevents liquid extract from collecting on the bottom surface of groove plate 900 ensuring that the flow from the plate to a collection tray or vessel is uninterrupted. Groove feature 906 may be provided using a ball milling tool. Likewise, capture groove 903 and exit groove 905 may be machined using a ball milling tool.

Referring now to FIG. 2 of the parent specification, groove plate 900 and an upper plate making up the plate platform are heated during press operation much like plates 107 and 108 are with internal heating elements such as an internal heating element 212 in plate 107 and an internal heating element 217 in plate 108. Referring now back to FIG. 9A, heating elements are not depicted in FIG. 9A or in FIG. 9B but may be assumed present. Heating elements may be ceramic coated heating elements connected by power and control line to a heat-control interface like heat-control interface 303 of FIG. 3 of the parent specification. Groove plate 900 may also accept a thermocouple device like thermocouple device 215 on plate 107 and thermocouple device 218 on plate 107 of FIG. 2.

Thermocouple devices are not depicted in groove plate 900 but may be assumed present. Monitoring plate heat state allows the machine press operator to measure plate temperature during press operation and to have feedback for making any required adjustments controlling the overall temperature settings of the plates during a material press operation. It may be noted herein that the areas in groove plate 900 of critical importance relative to maintaining a stable plate surface temperature are the press surface area 902 and the groove surface area 903 around the press surface. In one embodiment a heating element may be in the form of a circular ceramic heating element with a diameter less than groove 903 so it may nest within the plate concentrically to press surface 902 directly beneath it at a nominal depth placing it is proximity concentrically with groove 902.

In another embodiment, a heating component may include two elements or more, for example two semicircular ceramic coated heating elements connected to a same power and control line. Likewise, one or more than one thermocouple may be provided to measure temperature of groove plate 900 without departing from the spirit and scope of the present invention.

Figure 10A:
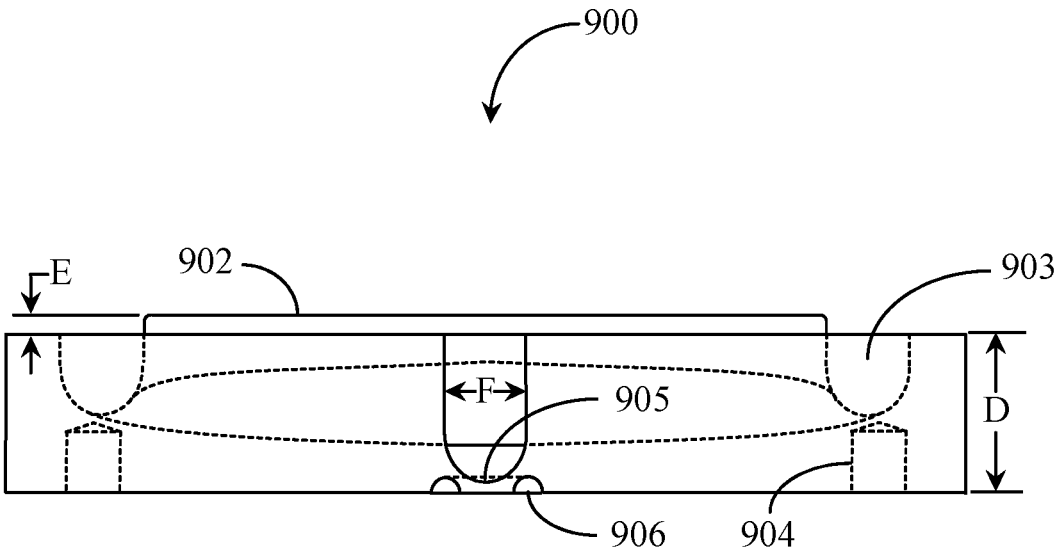
FIG. 10A is a front elevation view of the grooved platform press plate of FIG. 9A.

FIG. 10A is a front elevation view of grooved platform press plate 900 of FIG. 9A. Groove plate 900 may have an overall height or the total height equating to the sum of height dimension D from the bottom of the plate to the top plate surface outside of the press footprint and height dimension E from the uppermost plate surface outside of the press footprint to the press surface 902 defining the press footprint. The press surface 902 may be elevated any reasonable distance above the outer surface of the plate without departing from the spirit and scope of the invention. In this way, press force is constrained to PSI on the press surface footprint defined by press surface 902. Dimension E may be as small as one eighth inch for a smaller plate up to one quarter inch or so for a larger commercial plate for a larger commercial press machine. Dimension D may range from one- and one-half inches for a smaller plate to four inches or so for a larger commercial plate.

Groove feature 903 of groove plate 900 is depicted in hidden line to show relative groove depth and the angled downward slope (8 to 15-degree angle slope) of groove feature 903 as it progresses from the back end of the groove plate to the front end of the groove plate. Mounting openings 904 are represented in hidden lines. Exit groove 905 is depicted herein having a radiused bottom. The bottom of groove 905 stops short in depth of breaking through the bottom of groove plate 900. The bottom of grove 905 may in one embodiment, like groove 903, slope down in depth from the substantially orthogonal intersection with groove 903 to the front edge of groove plate 900.

The bottom of exit groove 905 is situated well below the bottom of groove feature 903 at the front and center of the groove plate. Exist groove 905 may have a width dimension the same as or comparable to the width dimension of groove feature 903. Inverted groove feature 906 may provide a flow-interruption barrier or dike to prevent any exiting oil or extract flowing out of the groove plate through exit groove 905 from adhering to and perhaps flowing across the bottom surface of the groove plate 900 and missing the collection vessel.

Figure 10B:
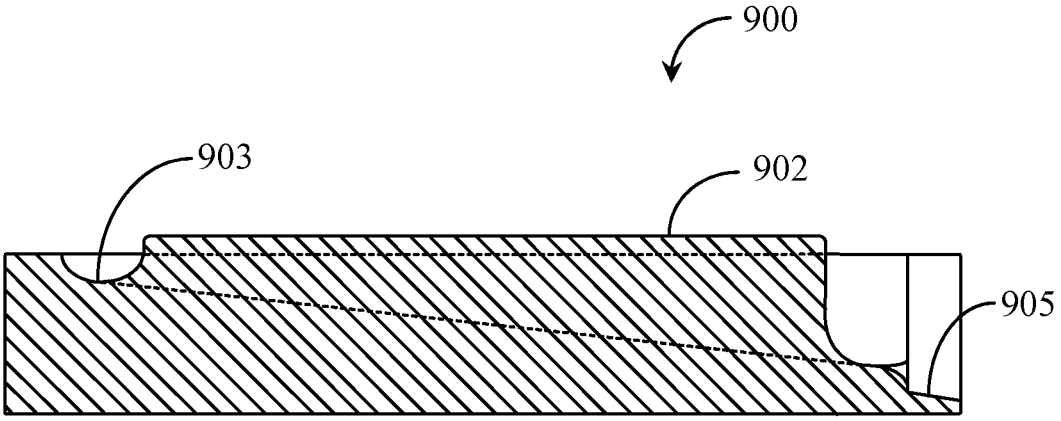
FIG. 10B is a section view of the grooved platform press plate of FIG. 9A taken along section line AA.

FIG. 10B is a section view of grooved platform press plate 900 of FIG. 9A taken along section line AA. In section AA, the rear of groove plate 900 is at left from the perspective of the viewer. Groove 903 may be shallowest at rear center, and deepest at front center of groove plate 900. The slope of the bottom of groove feature 903 from the shallow side or rear of the groove feature to the deep side or front of the groove feature is depicted herein in hidden line. The extracted oils flow into groove 903 after being pressed out of the raw materials on press plate surface 902. It may be noted herein that the heated extracts may enter groove 903 any point along the groove as they may be expelled peripherally outward from the raw materials and over the elevated edge of press surface 902 under pressure.

The constant controlled heat applied to groove plate 900, more particularly to press surface 902, groove features 903, and 905, keeps the viscosity of the oils or extracts low enough so that it quickly flows downward toward the front of groove plate 900 and cascades into exit groove 905 and then off of the plate into a collection vessel such as collection tray 402 of FIG. 4 in the parent specification. In this example, the slope angle of groove 903 may be approximately 8 to 10 degrees off horizontal. Groove 905 may also exhibit a slope angle, which may be comparable to or larger than the slope angle of groove 903. Temperatures for heating groove plate 900 may approach temperatures over 200 degrees Fahrenheit that begin to cause chemical reaction in the extract such as to release vapor. Therefore, a flow channel Technology™ is provided for automated egress of the extracted product from the plate. In this way, extracted product heated to low viscosity travels off groove plate 900 as expeditiously as possible. In a preferred embodiment, thermocouples provide temperature feedback to a controller that may be used to fine tune a groove plate temperature to produce a low viscosity high rate of flow without damaging the integrity or efficacy the extracted materials.

Figure 11B:
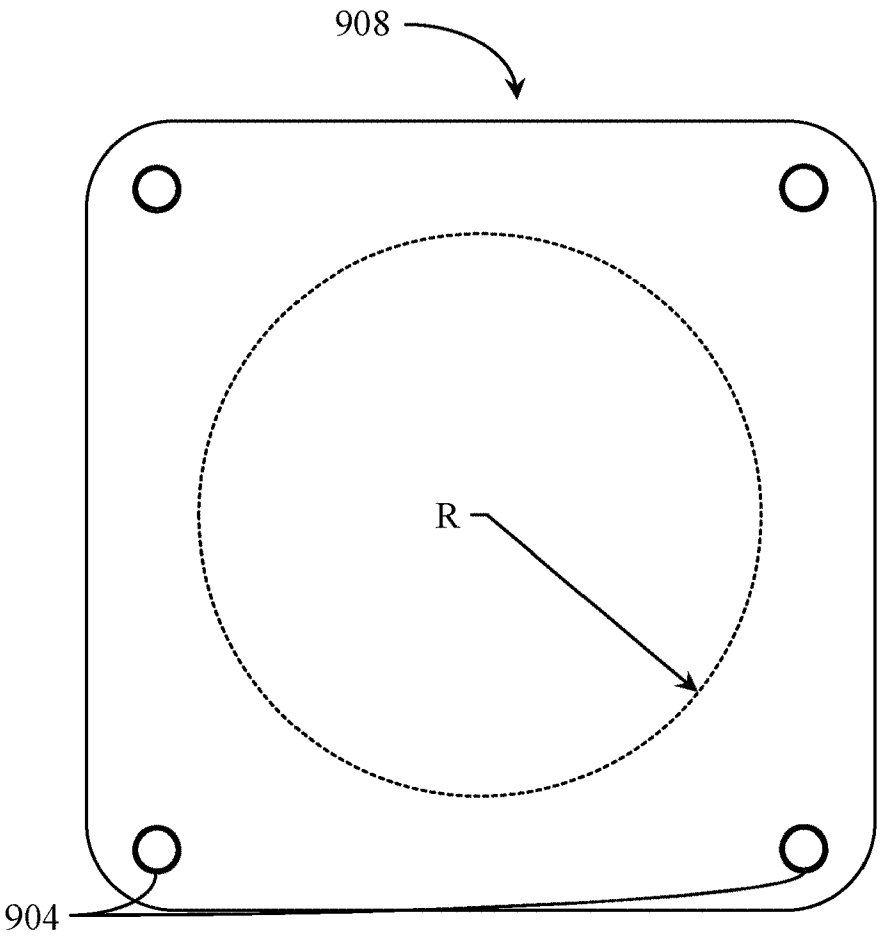
FIG. 11B is bottom view of the upper platform press plate of FIG. 11A.
Figure 11A:
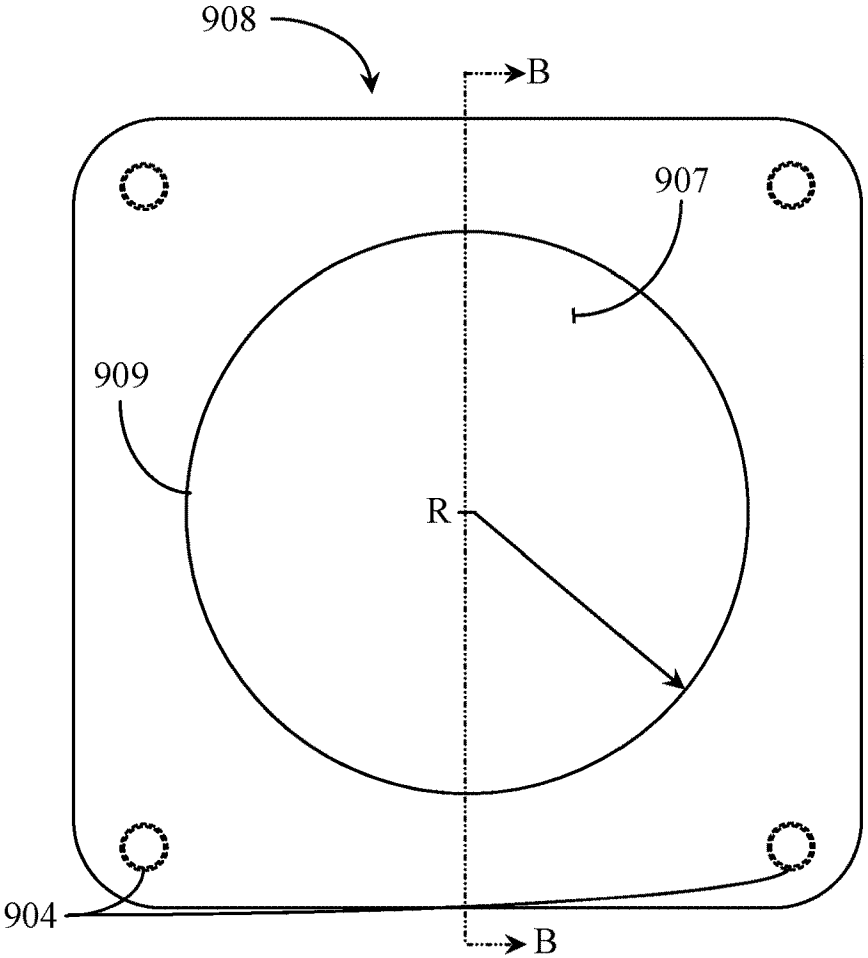
FIG. 11A is a top view of an upper platform press plate according to an embodiment of the present invention.

FIG. 11A is a top view of an upper platform press plate 908 according to an embodiment of the present invention. Upper platform press plate 908 is a press plate having a matching press footprint relative to press surface 902 of groove plate 900. Press plate 908 that may include a press surface 909 having a radius R significantly matching R of the groove plate press surface 902 of FIG. 10A. Press plate 908 interfaces with groove plate 900 at press surface 909. Press surface 909 may be coated with a non-stick Teflon-based material such as coating 907 depicted in FIG. 9A on the press surface and groove surfaces. There is a wide array of heat resistant and non-gassing Teflon surface coatings available in the art and known to the inventor that may be applied. Mounting openings 904 depicted in FIG. 9A are also provided to mount upper platform press plate 908 to the appropriate upper base plate in the press machine.

Press plate 908 may be a steel plate, an aluminum plate with a hard anodized surface, a steel plate with an anodized aluminum top cover or another suitable material that may withstand press exerted PSI on the press surface and may be heated efficiently and maintained at a stable temperature. The heat and pressure may create the liquid state of the extracted materials and enable the extracted materials to flow off the plate as a liquid. In one embodiment, press plate 908 may be a fixed or stationary plate with respect to ram travel of the press. If press plate 908 is a stationary plate, then groove plate 900 is the ram plate or traveling plate in the press machine.

The plates are aligned to one another in a vertical alignment for accommodation to a vertical press machine as illustrated in FIGS. 1-3 of the parent specification. The mechanics of the press machine that groove plate 900 and upper platform press plate are installed in are not relevant to the function of the present invention if the proper heating and press force may be obtained. The ram mechanics may be electric-driven such as using linear actuators or hydraulic-driven using hydraulic pressure cylinders without departing from the spirit and scope of the present invention.

In a preferred embodiment, groove plate 900 and upper platform press plate 908 may be obtained as a plate platform including the set of matching plates, the embedded heating elements for each plate, the thermocouples for each plate, and the power and control lines and control panel modules for setting and adjusting heat state of both plates and for displaying the current heat states of each plate. A version of the plate platform including groove plate 900 and upper platform press plate 908 may be fabricated for a variety of machine presses having capacities as small as one-half ounce (desktop consumer press) to as large as a pound and a half of pressed raw material (commercial grade press). PSI capacities for a range of applicable presses may range from 1500 pounds on the smaller end to 6000 pounds at the larger end.

FIG. 11B is bottom view of upper platform press plate 908 of FIG. 11A. In this view the press surface is depicted as a broken boundary and the mounting openings 904 are visible.

The underside of press plate 908 may include a compartment or interfacing feature for accepting a heating element. One or more bores may be placed into the plate from the side for installing one or more thermocouples. It is noted herein that the rectangular form of plate 908 is not a requirement to practice the invention.

A rectangular form for press plate 900 may be optimum for smaller press machines and perhaps lower capacity commercial press machines, but it might not be optimal for larger commercial machines due to the time required for heating the plates and time required before extracts may be directed off of the groove plate. For example, a different form or footprint for pressing might be optionally determined when a larger footprint is required to accommodate the stated capacities of the raw materials for press. For example, a press surface may be an elongated elliptical or an elongated rectangular form such as a rounded rectangle bounded by a melt groove feature that may also be elongated accordingly and may contain more than one to several intersecting exit grooves like exit groove 905 of FIG. 10A.

Figure 12A:
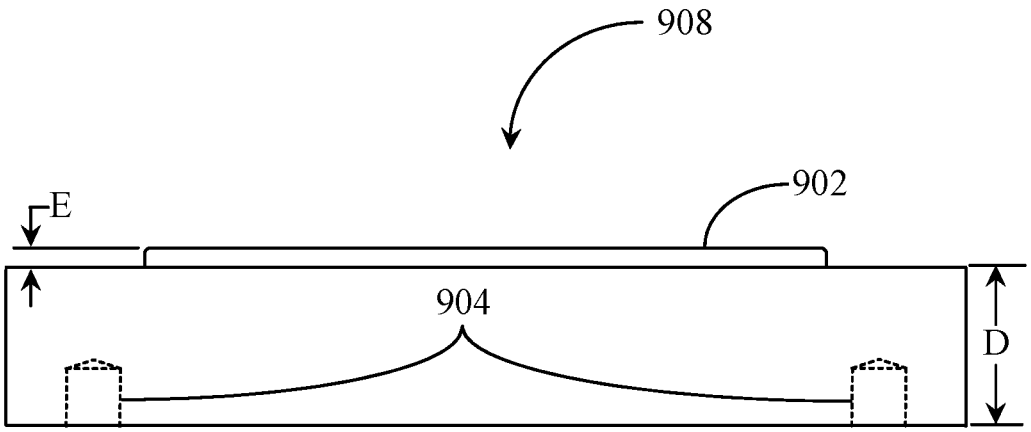
FIG. 12A is a front elevation view of the upper platform press plate of FIG. 11A.

FIG. 12A is a front elevation view of upper platform press plate 908 of FIG. 11A. In this front elevation view, dimension D and E are depicted and, taken as a sum, equal the overall depth dimension of the upper press plate 908. Dimension E may be the same as E on matching groove plate 900. Dimension D may be the same dimension as D on groove plate 900. A larger plate for a larger press machine may exhibit larger dimensions relative to press surface elevation and groove depth as well as groove width.

Figure 12B:
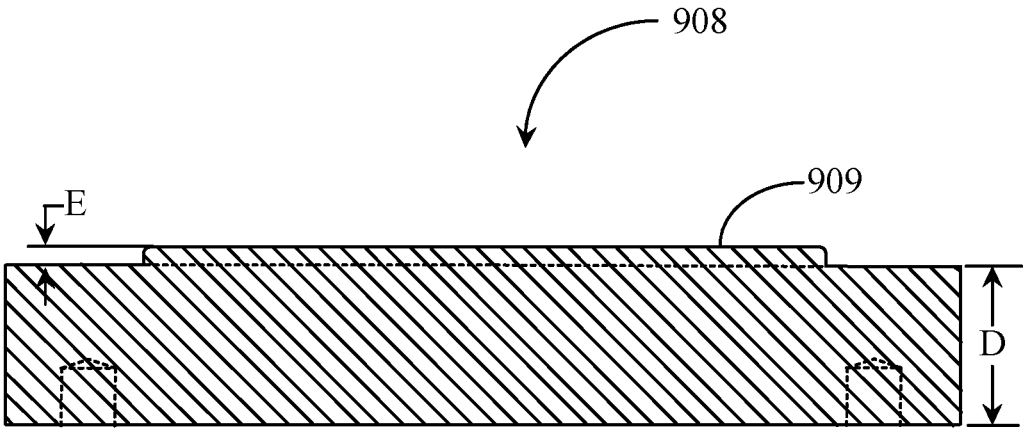
FIG. 12B is a section view of the upper platform press plate of FIG. 11A taken along section line BB.

FIG. 12B is a section view of upper platform press plate 908 of FIG. 11A taken along section line BB. In this section view, mounting openings 904 are depicted as hidden line features. The overall depth of the form 901 outside press surface 909 is extended in hidden line behind the press surface 909. In one embodiment of the present invention, more than one upper press plate and more than one groove plate (equal number of each) might be provided and mounted to the platform base plates of a larger capacity press machine where the plates are aligned adjacently on bottom and on top to form more elongated rectangular foot print where each press surface is isolated from the other press surfaces by the circular grooves. For example, one machine may host four groove plates and four matching upper platform plates wherein the plates are separately heated and hosting at least one thermocouple and wherein each groove plate on the bottom platform base plate has an exit groove into a collection vessel.

In one embodiment, a press footprint may consist of a press plate cover having a press surface and a melt groove with one or more exit grooves wherein the press plate cover sits flush over structurally sound heated plates arranged to support the press plate cover and wherein the individual heated plates are relieved of material to accommodate the cover, which may be fabricated of anodized aluminum plate or other suitable materials. In all configurations, the press surfaces of both groove plate and upper platform plate contacting the raw materials are heated as well as the groove feature and the exit groove feature. Mesh or other filter materials provided to keep raw materials from escaping the press surfaces may be provided of materials that do not obstruct the flow of liquified extract and may be disposed of with the spent raw materials or disposed of aside from the spent raw materials if such materials are selected to undergo some other processing not relative to extracting oils.

In a preferred embodiment, a vessel or vessels for collecting run off from the groove plate (s) rest on or are otherwise integrated with the base plates hosting the grooved press plate(s). Press surfaces may be machined or ground flat. In another embodiment, groove plate press surface 902 may be slightly convex and the matching opposing press plate surface 909 may be slightly concave. In still another embodiment, press surface 902 of groove plate 900 may include a pattern of smaller radial grooves arranged in a spoke pattern around the periphery of the press surface. For example, for a circular press surface the grooves may be provided with a downward slope angle leading outward from center and off the elevated press surface 902 into the adjacent groove 903.

Figure 13:
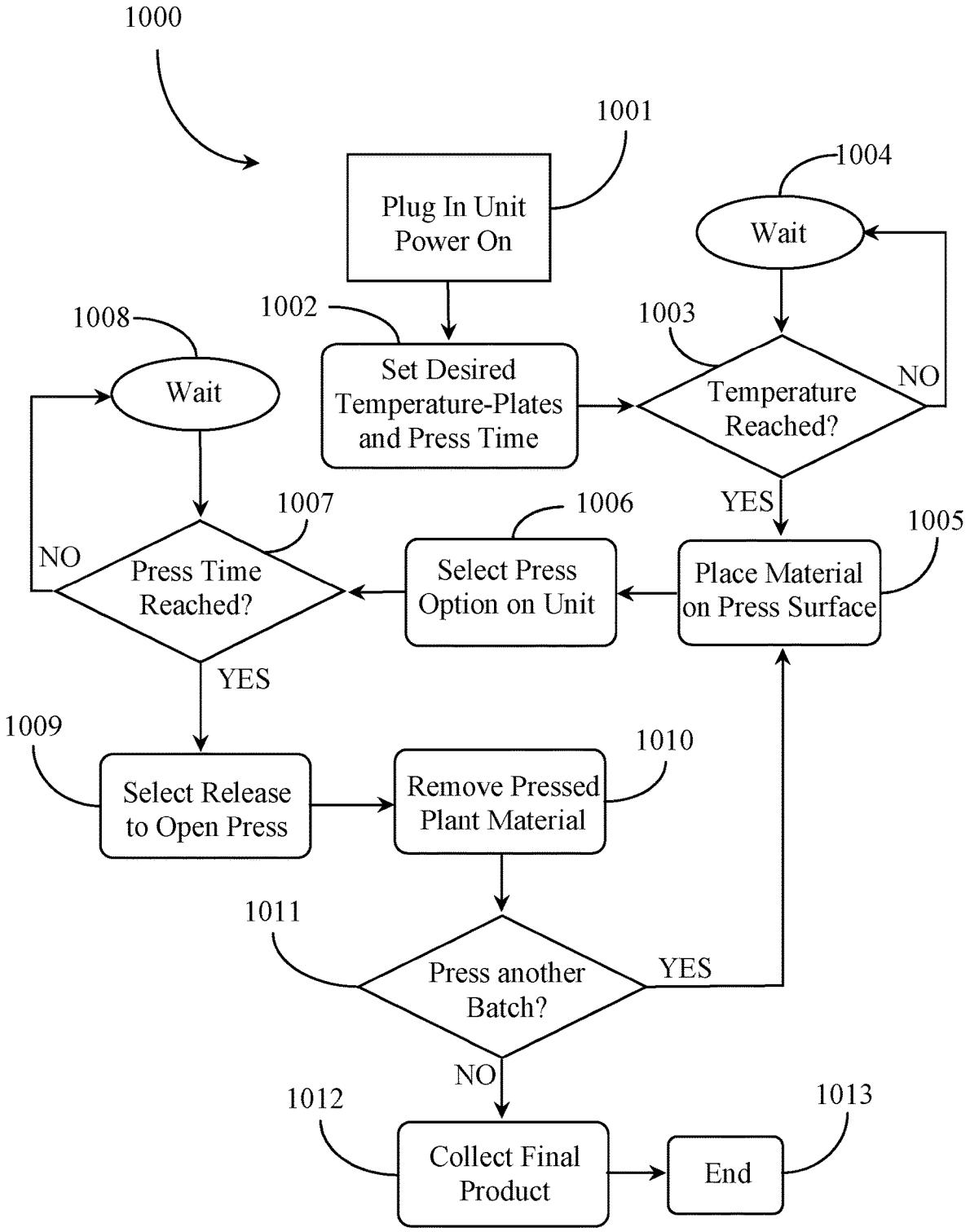
FIG. 13 is a process flow chart depicting steps for extracting a final product from a raw material using the press plate platform of the invention.

FIG. 13 is a process flow chart 1000 depicting steps for extracting a final product from a raw material using the press plate platform of the invention. At step 1001, a machine press operator may supply power to the machine press. At step 1002, the operator may set the desired temperature for the press plates and, if available, the press time that the plates will be pressed together during one press operation. Temperature may be changed by the user during press for one or both press plates by manually overriding the settings to raise or lower current plate temperatures. In a preferred embodiment for pressing *cannabis*, a temperature range from 185 degrees Fahrenheit to approximately 210 degrees Fahrenheit may define a broad "melt window". A user may experiment and make determinations based on empirical data and strain including "content" of cannabinoids like Tetrahydrocannabinol (THC) and Cannabidiol (CBD).

At step 1003, the operator may decide if the temperature of the plates has been attained or not. This may be enabled by thermocouple attachment to the plates and a small display component like a liquid crystal display (LCD), a light emitting diode (LED) display or some other visual indication that the correct plate temperatures are attained. If the operator determines the plates have not reached temperature for press, then the process may loop back to a wait cycle at step 1004. If at step 1003, the operator determined the plates have reached temperature for press, then the process may move on to step 1005. At step 1005, the operator may place the raw materials for press onto the press plate surface of the grooved press plate analogous to groove plate 900 of FIG. 9A.

In one embodiment, the material is flower material from a *cannabis* plant or leaf and stalk material from a hemp plant and the extract is a raw CBD oil with or without THC depending on the selected raw materials. In other embodiments, the raw materials may include a wide variety of different plant types containing plant oils or extracts that might be separated from the raw materials by heat press. The raw material may be contained in a filter mesh, bag, or pouch that functions to prevent raw material particulate from escaping the groove plate press surface and perhaps be carried into the adjacent groove feature with the heated extracts.

At step 1006, the operator may select the press option on the hosting machine press control panel or control unit. Initiating press causes one of the plates, in this example, the groove plate to travel up and abut against the press surface of the upper stationary press plate, the material under press between the heated surfaces. At step 1007, the operator determines whether the correct press time has been reached. If the operator was able to set the press time, then the end of the press period may be automated, and the operator does not need to initiate press release as the plates may move apart by automated routine when the preset press time expires.

In one aspect of the method, the operator observes and determines by an indicator such as a flashing light with or without an audio tone or beep that the preset press time has been reached. In this case, the process may move to step 1009. At step 1009, the operator may select or push a release button to initiate press opening. In still another aspect, the operator does not preset a press time but may simply observe the state of melt and outflow of extracts or oils from the groove plate into the collection vessel and may determine when to separate the press plates at step 1009. By observing the state of flow of the pressed extracts or oils, the operator may also have an opportunity to adjust the temperatures of one or both press plates. In one embodiment, a period of inactivity at the press may cause the power control module on the press unit to shut off power to the heating elements and thermocouples in the press plates.

At step 1010, the operator may remove the spent plant material and mesh filter from the press plate surface of the groove plate. In one embodiment, the raw material filter is a poly bag or synthetic material bag or a flexible metal screen having a fine enough meshing to prevent particulates from contaminating the pressed oils or extracts. In one aspect of the method, the raw material filters are bags that hold a specific amount of raw material appropriate for the maximum utility of the groove plate press surface. At step 1011, the operator may decide whether to press a subsequent batch. If the operator decides to press another batch at step 1011, the process may loop back to step 1005 where the operator places the subsequent batch of material on the press plate surface of the groove plate to press. If the operator decides not to run another batch of material that step 1011, the process may move to step 1012. At step 1012, the operator may stop and collect the final product by removing the collection vessel. At step 1013 the process may end.

Figure 14:
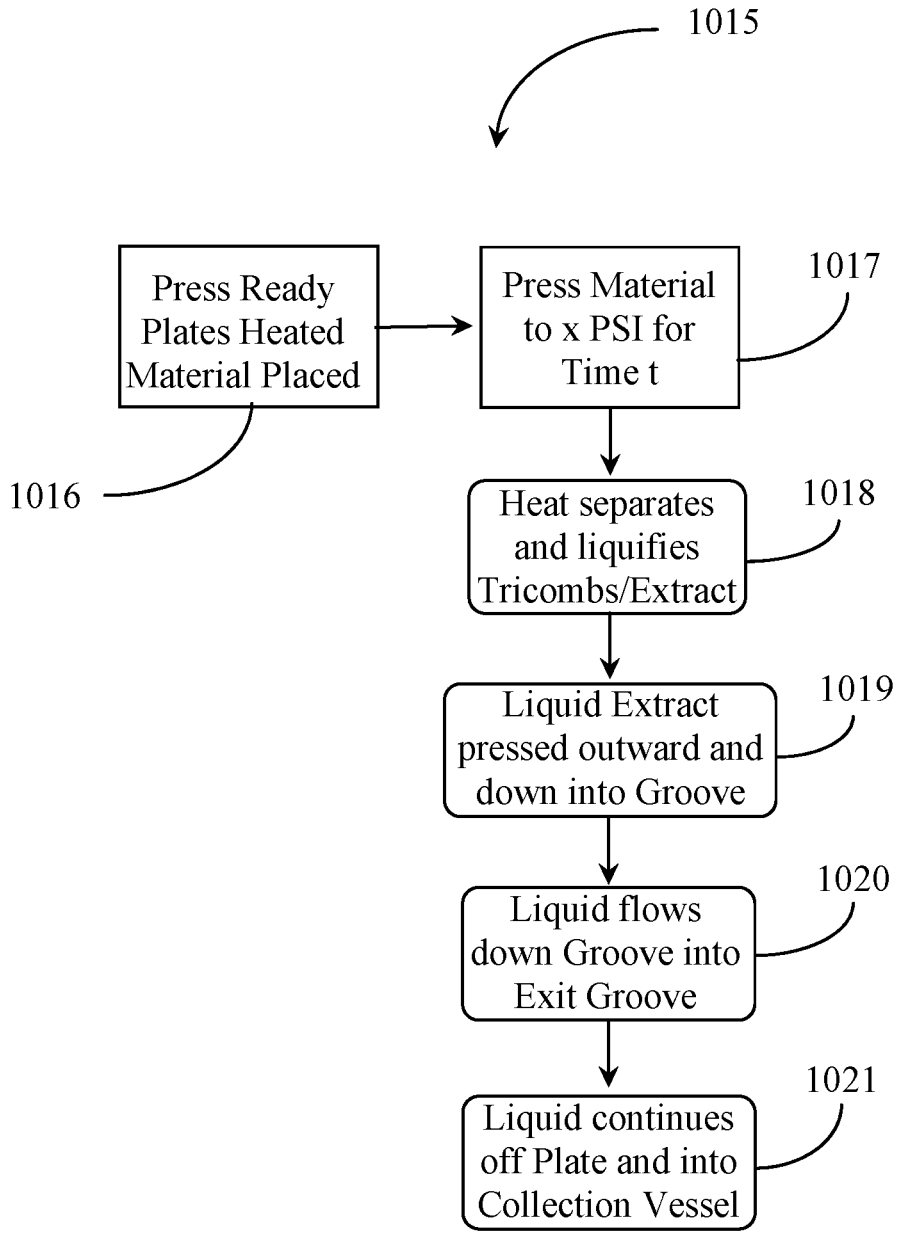
FIG. 14 is a process flow chart depicting resulting action states of raw material extract from press to collection according to an aspect of the invention.

FIG. 14 is a process flow chart 1015 depicting resulting action states of raw material extract from press to collection according to an aspect of the invention. At step 1016 it is assumed that the press plates are ready (heated to temperature) and the raw material for press has been placed on the press surface of the groove plate. In this step, a press time may also be set.

At step 1017, the machine press presses the material between the heated press plates under x PSI for time t. At step 1018 during time t, the heat liquifies or melts the trichomes as the raw material is being pressed. At step 1019, the liquid extract is pressed out of the raw materials and flows outward and down over the edge of the groove plate press surface into the adjacent groove feature. At step 1020, the pressed oils or extracts travels down the groove feature on both sides of the groove plate toward the exit and cascades downward into the exit groove. At step 1021, the pressed liquid continues flow at low viscosity off the groove plate and into a placed collection vessel. A collection vessel may be a shallow tray made of metal, a glass vessel or a vial designed to be filled and caped.

It will be apparent to one with skill in the art that the press plate platform including the groove plate and flow channel Technology™ of the invention may be provided using some or all the mentioned features and components without departing from the spirit and scope of the present invention. It will also be apparent to the skilled artisan that the embodiments described above are specific examples of a single broader invention that may have greater scope than any of the singular descriptions taught. There may be many alterations made in the descriptions without departing from the spirit and scope of the present invention. The scope of the invention shall be limited only by the breath of the claims below.

What is claimed is:

1. A press plate comprising:

a form characterized as having a capacity to conduct and transfer heat, the press plate having an overall length, an overall width, and an overall thickness;

a mounting interface disposed on an underside of the press plate for mounting the press plate onto a press machine;

a press surface defining a press footprint disposed on top and center of the press plate, the press surface elevated above the rest of other top surface area of the press plate, the press surface having a peripheral edge;

a first interface provided within the press plate, one or more heating components is mounted to the first interface;

a second interface provided within the press plate, one or more temperature sensing and feedback components is mounted to the second interface;

a first groove disposed adjacently to the peripheral edge of the press surface such that the peripheral edge of the press surface and an edge of the first groove are the same edge; and a second groove disposed orthogonally to the first groove, a top edge of the second groove intersecting the first groove at a lower elevation of the first groove, the second groove breaking out of the press plate at one end of the press plate.

2. The press plate of claim 1, wherein the press plate is fabricated of steel or of aluminum or of both materials.

3. The press plate of claim 1, wherein the mounting interface is a pattern of threaded openings for mounting the press plate to a platform base of a press machine.

4. The press plate of claim 1, wherein the press surface has a diameter and the first groove is a circular groove bounding the press surface.

5. The press plate of claim 1, wherein the first and second interfaces are machined into the press plate as one or more compartments or bores for accepting the one or more heating components and temperature sensing and feedback components within the press plate.

6. The press plate of claim 1, wherein the one or more heating components is a ceramic heating element and the one or more temperature sensing and feedback components is a thermocouple.

7. The press plate of claim 1, wherein the first groove is graduated in depth from a shallow depth at a rear of the press plate to a deeper depth at the intersection with the second groove at a front of the press plate.

8. The press plate of claim 1, wherein the second groove is graduated in depth from a shallow depth at the intersection with the first groove to a deeper depth at an edge of the press plate.

9. The press plate of claim 1, wherein the first and second grooves are radiused grooves.

10. The press plate of claim 1, wherein the press plate is a lower plate mountable to a vertical press machine leveraging gravity to transfer pressed liquid from the press surface off the press plate through the first and second grooves.

11. The press plate of claim 1, wherein the press plate is built to size for a specified capacity of a vertical press machine, the capacity ranging from a machine pressing one ounce of material in a portable desktop vertical press machine to a machine pressing up to one and one half pounds of organic material in a commercial vertical press machine.

12. A method for extracting oils and or extracts from organic materials using a press plate having a form characterized as having a capacity to conduct and transfer heat, the press plate having an overall length, an overall width, and an overall thickness, a mounting interface disposed on an underside of the press plate for mounting the press plate onto a vertical press machine, a press surface defining a press footprint disposed on top and center of the press plate, the press surface elevated above the rest of other top surface area of the press plate, the press surface having a peripheral edge, a first interface provided within the press plate, one or more heating components is mounted to the first interface, a second interface provided within the press plate, one or more temperature sensing and feedback components is mounted to the second interface, a first groove disposed adjacently to the peripheral edge of the press surface such that the peripheral edge of the press surface and an edge of the first groove are the same edge; and a second groove disposed orthogonally to the first groove, a top edge of the second groove intersecting the first groove at a lower elevation of the first groove, the second groove breaking out of the press plate at one end of the press plate, the method comprising:

(a) heating the press plate to a temperature sufficient to liquify and separate organic compounds in the organic materials;

(b) placing an amount of organic materials on the press surface of the plate;

(c) pressing the organic materials with the aid of an opposing press plate having a press surface, a capacity through one or more heating elements to conduct and transfer heat and one or more temperature sensors to provide feedback; and (d) collecting liquid oils and or extracts having flowed down the first and second grooves into a collection vessel.

13. The method of claim 12, wherein the opposing press plate having a foot print matching the press plate as a press plate platform for installation into the vertical press machine.

14. The method of claim 13, wherein the press plate is provided with other components include heating elements, thermocouples, power lines, control lines, and feedback lines, and at least one controller for heating the plates.

15. The method of claim 12, wherein in step (a) the temperature and a press time are preset for the amount of organic material pressed.

16. The method of claim 12, wherein in step (b), the organic material for press is placed in a filter adapted to prevent particulate matter from entering the first groove.

17. The method of claim 12, wherein in step (d), the first and second grooves are radiused grooves.

* * * * *